US008270875B2

(12) United States Patent
Fujita et al.

(10) Patent No.: US 8,270,875 B2
(45) Date of Patent: Sep. 18, 2012

(54) IMAGE FORMING APPARATUS

(75) Inventors: Junpei Fujita, Sagamihara (JP); Toshitaka Yamaguchi, Sagamihara (JP); Ryoh Tanoue, Yokohama (JP); Masaharu Furuya, Yokohama (JP); Takuya Sekine, Yokohama (JP); Katsuhito Haruno, Sagamihara (JP)

(73) Assignee: Ricoh Company, Ltd., Tokyo (JP)

( * ) Notice: Subject to any disclaimer, the term of this patent is extended or adjusted under 35 U.S.C. 154(b) by 416 days.

(21) Appl. No.: 12/560,796

(22) Filed: Sep. 16, 2009

(65) Prior Publication Data

US 2010/0067952 A1 Mar. 18, 2010

(30) Foreign Application Priority Data

Sep. 17, 2008 (JP) ..... 2008-238509

(51) Int. Cl.
*G03G 21/00* (2006.01)

(52) U.S. Cl. ..... 399/124; 399/316

(58) Field of Classification Search ..... 399/121, 399/124, 164, 297, 317, 316
See application file for complete search history.

(56) References Cited

U.S. PATENT DOCUMENTS

2008/0187343 A1* 8/2008 Yamaguchi et al. ..... 399/74

FOREIGN PATENT DOCUMENTS

| | | |
|---|---|---|
| JP | 2004-244193 | 9/2004 |
| JP | 2006-234906 | 9/2006 |
| JP | 3981859 | 7/2007 |

OTHER PUBLICATIONS

U.S. Appl. No. 12/828,612, filed Jul. 1, 2010, Furuya, et al.

* cited by examiner

*Primary Examiner* — Walter L Lindsay, Jr.
*Assistant Examiner* — Barnabas Fekete
(74) *Attorney, Agent, or Firm* — Oblon, Spivak, McClelland, Maier & Neustadt, L.L.P.

(57) ABSTRACT

An image forming apparatus includes a toner image carrying member, an image transfer device, a fixing device, a registration unit, a guide member, an upstream-side transportation unit, and a downstream-side transportation unit. The image transfer device transfers a toner image from the toner image carrying member to a recording medium. The fixing device fixes the toner image. The registration unit transports the recording medium. The guide member guides the recording medium. The upstream-side transportation unit includes an upstream-side transportation member, disposed at an upstream side in the transport direction of the recording medium. The downstream-side transportation unit includes the downstream-side transportation member, disposed at a downstream side in the transport direction of the recording medium. The upstream-side transportation unit includes an upstream-side positioning member to position the guide member to the upstream-side transportation member. The downstream-side transportation unit includes a downstream-side positioning member to position the guide member to the downstream-side transportation member.

24 Claims, 14 Drawing Sheets

IMAGE FORMING APPARATUS

CROSS-REFERENCE TO RELATED APPLICATIONS

This application claims priority to Japanese Patent Application No. 2008-238509, filed on Sep. 17, 2008 in the Japan Patent Office, which is hereby incorporated by reference herein in its entirety.

BACKGROUND OF THE INVENTION

1. Field of the Invention

The present invention relates to an image forming apparatus such as a copier, printer, facsimile machine, or the like, and more particularly, to an image forming apparatus that transfers a toner image from a toner image carrying member to a recording medium.

2. Description of the Background Art

Typically, in image forming apparatuses, a toner image developed on a latent image carrying member is transferred to a recording medium such as transfer sheet either directly or via an intermediate transfer member. The toner image is then fixed on the recording medium by using a fixing unit. The recording medium is transported along a transportation route inside the image forming apparatus using a transportation member, which moves the recording medium.

Thus, the recording medium passes through a transfer position (or transfer nip), at which the toner image is transferred to the recording medium from an image carrying member or an intermediate transfer member. Then, the recording medium passes through a fixing position (or fixing nip) in the fixing unit, at which the toner image is fixed on the recording medium. Finally, the recording medium is discharged to a sheet discharge tray or the like.

In such image forming apparatuses, the recording medium may be transported along the transportation route from an upstream side to a downstream side of transport direction using a plurality of transportation members disposed at a plurality of positions along the transportation route. For example, such transportation members may be a pair of rollers (paired rollers), in which two rollers facing each other rotate to transport the recording medium. Accordingly, the recording medium is transported from one pair of rollers, disposed at the upstream side of sheet transport direction, to another pair of rollers, disposed at the downstream side of sheet transport direction. Such rollers may be referred to as surface moving members.

In such image forming apparatuses, one or more guide members may be disposed between adjacent transportation members, set along a transport direction of the recording medium. The guide member guides the recording medium from one transportation member, disposed at the upstream side of sheet transport direction, to another transportation member, disposed at the downstream side of sheet transport direction, by controlling a movement direction and/or orientation of the recording medium.

In such image forming apparatuses, the recording medium may be transported in two ways: in a horizontal transportation type, the recording medium is transported in a substantially horizontal direction; in a vertical transportation type, the recording medium is transported in a substantially vertical direction.

In the horizontal transportation type, when the recording medium is transported between adjacently disposed transportation members disposed along the transport direction of recording medium, the recording medium can be easily guided by a guide member, disposed between the adjacent transportation members and under the transportation route for the recording medium. Such easy transportation may be conducted because the guide member is disposed under the transportation route, in which the force of gravity can be used to enable the recording medium to be easily guided by the guide member.

By contrast, in the vertical transportation type, adjacent transportation members may be disposed in a vertical direction along the transport direction of recording medium, and a guide member is disposed at a lateral side of the transport direction, which means the guide member is also disposed in a vertical direction. Consequently, the force of gravity cannot be used to guide the recording medium and as a result the recording medium may not be guided by the guide member effectively.

JP-2006-234906-A and JP-3981859-B discuss an image forming apparatus using the vertical transportation type. In such image forming apparatus, a transfer position (or transfer nip) is set by an intermediate transfer belt (used as an intermediate transfer member) and a secondary transfer roller, and a registration roller is disposed under the transfer position and a fixing unit is disposed above the transfer position. In such image forming apparatus, the intermediate transfer belt and the secondary transfer roller, which transport the recording medium at the transfer position while sandwiching the recording medium, a fixing roller, which sets a fixing nip in the fixing unit, and the registration rollers are used as transportation members, wherein such belt and rollers apply transportation force to the recording medium.

Further, at the transfer position, an entry-side guide member is disposed at an upstream side transport direction, and an exit-side guide member is disposed at a downstream side of sheet transport direction. In such image forming apparatus, the recording medium is transported from the registration roller to the transfer position along the transportation route. Accordingly, relative positions of the registration roller and the entry-side guide member, and relative positions of the transfer position and the exit-side guide member may be set to a given value. Consequently, if such relative positions deviate from the set value, the recording medium may not be accurately transported in the transportation route.

For example, if the recording medium is not accurately transported from the registration roller to the transfer position in the transportation route, a leading edge of the recording medium may be askew with respect to the transport direction, and the recording medium enters the transfer position with the leading edge askew. If the recording medium enters to the transfer position as such, a toner image may be transferred on the recording medium while an orientation of toner image may be slanted from a horizontal or vertical direction of the recording medium, by which an image may not be accurately formed on the recording medium.

Further, the recording medium is transported from the transfer position to the fixing nip along the transportation route. Accordingly, relative positions of the transfer position and the exit-side guide member, and relative positions of the exit-side guide member and the fixing nip may be set to a given value. Accordingly, if such relative positions deviate from the set value, the recording medium may not be accurately transported in the transportation route. Such deterioration of transportation of the recording medium in the transportation route may cause flipping movement of recording medium, which may wrinkle the recording medium (e.g., sheet) when the recording medium passes the fixing unit.

Such inconvenience may be solved by setting one configuration for a secondary transfer unit including a secondary transfer roller, an entry-side guide member, and an exit-side guide member. The entry-side guide member is disposed before a secondary transfer nip, and the exit-side guide member is disposed after the secondary transfer nip to guide a sheet in the secondary transfer unit. The secondary transfer unit may be detachably mounted to the image forming apparatus. Such secondary transfer unit may have a casing to support the secondary transfer roller, the entry-side guide member, and the exit-side guide member by fixing such members to the casing. If such configuration is employed, relative positions of a guide member and the secondary transfer roller can be set precisely, by which relative positions of the entry-side guide member and the transfer position, and relative positions of the transfer position and the exit-side guide member, may be maintained at a preferred level.

However, the position of the secondary transfer unit installed in a housing of the image forming apparatus may vary from one manufactured image forming apparatus to the next. For example, the secondary transfer unit may be attached to an outer cover of image forming apparatus. When such assembly is employed, a position of the secondary transfer unit installed in the housing of image forming apparatus may vary due to assembly tolerances. Such assembly tolerances may include tolerance of the secondary transfer unit to the outer cover, tolerance of the outer cover to the housing of image forming apparatus, or the like.

Further, recently, nip pressure at a secondary transfer nip is set higher. Such high nip pressure may cause deformation of components of image forming apparatus. Using stronger components may prevent such deformation but also result in an increase in manufacturing cost.

Further, such deformation caused by the nip pressure may vary from one manufactured image forming apparatuses to the next depending on the components used, by which a position of the secondary transfer unit in the housing of image forming apparatus may fluctuate. Further, instability in the position of the secondary transfer unit in the image forming apparatus may occur for other reasons.

Once positional instability in the secondary transfer unit occurs in the image forming apparatus, a position of the secondary transfer unit relative to the fixing unit and the registration rollers also becomes unstable. If positional instability occurs between the secondary transfer unit and the registration rollers, precise relative positioning of the registration roller and the entry-side guide member at the transfer position may become unattainable, by which the recording medium may not be transported accurately from the registration roller to the transfer position in the transportation route. If such inaccurate transportation occurs in the transportation route, an image may not be accurately formed on the recording medium.

Further, if positional instability occurs between the secondary transfer unit and the fixing unit, precise relative positioning between the exit-side guide member at the transfer position and the fixing nip may also become unattainable, by which the recording medium may not be transported accurately from the transfer position to the fixing nip in the transportation route. If such inaccurate transportation occurs from the transfer position to the fixing nip in the transportation route, another failure such as sheet jamming may occur.

Such sheet jamming caused by inaccurate transportation may occur between the registration roller and the transfer position, or between the transfer position and the fixing position. Further, such sheet jamming caused by inaccurate transportation may occur at other parts of the transport route. For example, a guide member may be disposed between two transportation members in the transport route, in which one transportation member is disposed at a upstream side of sheet transportation direction of recording medium and other transportation member is disposed at a downstream side transport direction of recording medium. In such configuration, if positional instability occurs between the two transportation members, the above-described sheet jamming may occur.

SUMMARY

In one aspect of the invention, an image forming apparatus is devised. An image forming apparatus includes a toner image carrying member, an image transfer device, a fixing device, a registration unit, a guide member, an upstream-side transportation member, an upstream-side transportation unit, a downstream-side transportation member, and a downstream-side transportation unit. The toner image carrying member carries a toner image and moves endlessly. The image transfer device transfers the toner image from the toner image carrying member to a recording medium at a transfer position. The transfer position is set between the toner image carrying member and the image transfer device. The fixing device, disposed at a downstream side of the transfer position, fixes the toner image, transferred by the image transfer device on the recording medium, on the recording medium at a fixing position. The registration unit transports the recording medium to the transfer position at a given timing. The registration unit is disposed at an upstream side of the transfer position. The guide member guides movement of the recording medium. The guide member is shaped to facilitate movement of the recording medium. The upstream-side transportation member, disposed at an upstream side in a transport direction of the recording medium with respect to the guide member, moves the recording medium. The upstream-side transportation unit includes the upstream-side transportation member. The downstream-side transportation member, disposed at a downstream side in the transport direction of the recording medium with respect to the guide member, moves the recording medium. The downstream-side transportation unit includes the downstream-side transportation member. The upstream-side transportation unit includes an upstream-side positioning member to position the guide member to the upstream-side transportation member. The downstream-side transportation unit includes a downstream-side positioning member to position the guide member to the downstream-side transportation member. The guide member, disposed between the upstream-side transportation unit and the downstream-side transportation unit, is positioned by the upstream-side positioning member and the downstream-side positioning member.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
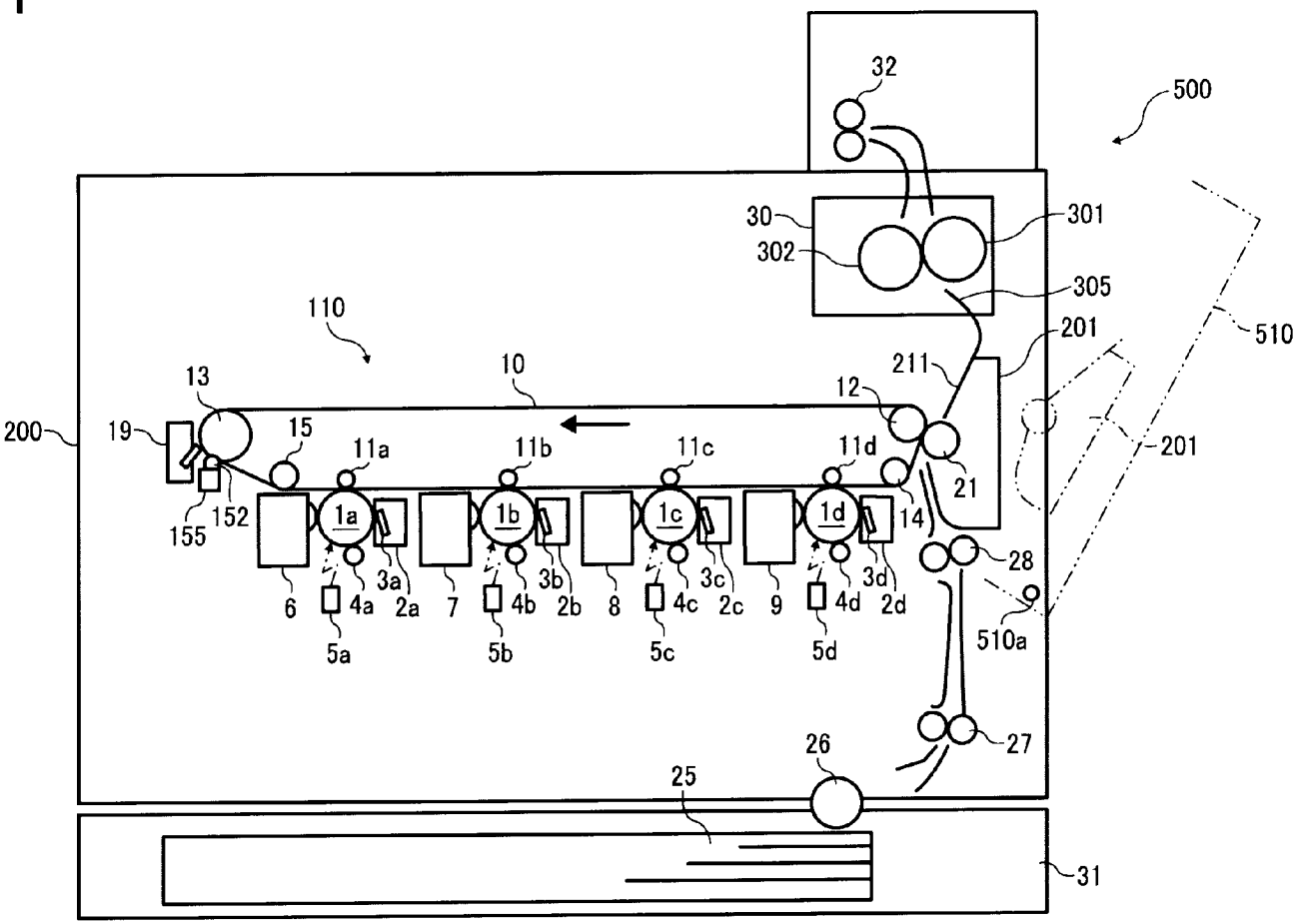
FIG. 1 illustrates a schematic configuration of an image forming apparatus according to a first example embodiment.

The accompanying drawings are intended to depict exemplary embodiments of the present invention and should not be interpreted to limit the scope thereof. The accompanying drawings are not to be considered as drawn to scale unless explicitly noted, and identical or similar reference numerals designate identical or similar components throughout the several views.

DETAILED DESCRIPTION OF EXEMPLARY EMBODIMENTS

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Furthermore, although in describing expanded views shown in the drawings, specific terminology is employed for the sake of clarity, the present disclosure is not limited to the specific terminology so selected and it is to be understood that each specific element includes all technical equivalents that operate in a similar manner.

Referring now to the drawings, an image forming apparatus according to an exemplary embodiment is described. The image forming apparatus may be a color image forming apparatus, for example, but not limited thereto. In the following description, "position" or "positioning" may indicate that a given member is attached or engaged to another member with secure manner while the given member is detachable from another member, as required.

A description is now given to an image forming apparatus according to an exemplary embodiment. FIG. 1 shows an image forming apparatus 500 according to an exemplary embodiment. The image forming apparatus 500 may employ an electrophotographic system, and a tandem-type intermediate transfer system using an intermediate transfer belt as an intermediate transfer member, which may be also referred as a toner image carrying member.

The image forming apparatus 500 includes an apparatus housing 200 and a sheet feed unit 31 disposed under the apparatus housing 200. The image forming apparatus 500 includes an intermediate transfer belt 10 extended by a plurality of extension members in a center of the apparatus housing 200. The intermediate transfer belt 10 is used as a toner image carrying member.

The image forming apparatus 500 includes four photoconductors 1*a*, 1*b*, 1*c*, and 1*d* disposed under an extended face of the intermediate transfer belt 10. The photoconductors 1*a*, 1*b*, 1*c*, and 1*d* may be used as latent image carrying member. Around the photoconductors 1*a*, 1*b*, 1*c*, and 1*d*, photoconductor cleaning units 2*a*, 2*b*, 2*c*, and 2*d*, charge units 4*a*, 4*b*, 4*c*, and 4*d*, exposure units 5*a*, 5*b*, 5*c*, and 5*d*, and primary transfer bias rollers 11*a*, 11*b*, 11*c*, and 11*d* are disposed. The primary transfer bias rollers 11*a*, 11*b*, 11*c*, and 11*d* face the photoconductors 1*a*, 1*b*, 1*c*, and 1*d* by interposing the intermediate transfer belt 10 therebetween.

Further, the photoconductor cleaning units 2*a*, 2*b*, 2*c*, and 2*d* include photoconductor cleaning blades 3*a*, 3*b*, 3*c*, and 3*d* as cleaning members. The photoconductor cleaning blades 3*a*, 3*b*, 3*c*, and 3*d* are pressed to a surface of the photoconductors 1*a*, 1*b*, 1*c*, and 1*d* to clean the surface of the photoconductors 1*a*, 1*b*, 1*c*, and 1*d*.

The image forming apparatus 500 includes four development units such as a yellow development unit 6 facing the yellow photoconductor 1*a*, a magenta development unit 7 facing the magenta photoconductor 1*b*, a cyan development unit 8 facing the cyan photoconductor 1*c*, and a black development unit 9 facing the black photoconductor 1*d*. When a full color image is formed, a toner images may be formed on the yellow development unit 6, the magenta development 7, the cyan development unit 8, and the black development unit 9 in this order, and then toner images of each color are transferred onto the intermediate transfer belt 10 superimposingly, by which a full color image is formed.

The intermediate transfer belt 10 is extended by the primary transfer bias rollers 11*a*, 11*b*, 11*c*, and 11*d*, a secondary-transfer counter roller 12, a first driven roller 14, a second driven roller 15, and a belt support roller 13, for example, in which the secondary-transfer counter roller 12 may be used a drive roller of the intermediate transfer belt 10. When a drive motor drives the secondary-transfer counter roller 12, the intermediate transfer belt 10 can travel endlessly at a given process speed (or surface moving speed). For example, the intermediate transfer belt 10 may travel at a process speed of 150 mm/sec.

Further, the intermediate transfer belt 10 may be disposed in a transfer belt housing having a side plate on each lateral side of the intermediate transfer belt 10, wherein the lateral side of the intermediate transfer belt 10 is perpendicular to a surface moving direction of the intermediate transfer belt 10. Such side plate can be used to support rollers extending the intermediate transfer belt 10.

The primary transfer bias roller 11 is disposed at a position where the photoconductor 1 and the intermediate transfer belt 10 contact each other, and the primary transfer bias roller 11 is applied with a given transfer bias voltage. For example, in the image forming apparatus 500, the primary transfer bias roller 11 is applied with +1800 V.

The intermediate transfer belt 10 may be formed as a single layer or a multiple layer. Such layer may be made of PVDF (polyvinylidene difluoride), ETFE (polyethylene-tetrafluoroethylene), PI (polyimide), PC (polycarbonate), or the like, and an electrically-conductive material such as carbon black may be dispersed in the layer to adjust a volume resistivity and a surface resistivity of the intermediate transfer belt 10 at a given level. For example, the intermediate transfer belt 10 may have volume resistivity from $10^8$ Ωcm to $10^{12}$ Ωcm, and surface resistivity from $10^9$ Ωcm to $10^{13}$ Ωcm. Further, a separation layer may be coated on the intermediate transfer belt 10, as required. For example, such separation layer may be made of fluorine resin such as ETFE (polyethylene-tetrafluoroethylene), PTFE (polytetrafluoroethylene), PVDF (polyvinylidene difluoride), PEA (perfluoro-alkoxyfluoro plastics), FEP (Fluorinated ethylene propylene copolymer), and PVF (polyvinyl fluoride), but not limited thereto.

The intermediate transfer belt 10 can be made by employing known method such as a pouring/injecting method, a centrifugal moulding method, and the surface of intermediate transfer belt 10 may be polished as required.

As shown in FIG. 1, a belt cleaning unit 19 is disposed at a position facing the belt support roller 13 via the intermediate transfer belt 10, in which the belt cleaning unit 19 cleans the intermediate transfer belt 10.

The secondary transfer roller 21 faces the secondary-transfer counter roller 12 via the intermediate transfer belt 10, and the secondary transfer roller 21 is used as image transfer device, which is used to transfer an image (e.g., toner image) to a recording medium. The secondary transfer roller 21 includes a metal core, made of stainless steel (SUS) or the like, and an elastic layer coated on the metal core. The elastic layer may be made of an elastic material (e.g., urethane) having a given resistance value by including a conductive material. For example, the resistance value is adjusted from $10^6$Ω to $10^{10}$Ω.

Further, the secondary transfer roller 21 contacts the intermediate transfer belt 10 while pressing the secondary-transfer counter roller 12 via the intermediate transfer belt 10. Accordingly, when the intermediate transfer belt 10 moves endlessly, the secondary transfer roller 21 can be rotated by a surface movement of the intermediate transfer belt 10. Instead of such configuration, a secondary transfer roller can be rotated independently in an image forming apparatus, in which the present invention can be similarly applied. The secondary transfer process may be controlled by using a constant current. For example, a constant current of +30 μA is used for the image forming apparatus 500.

The sheet feed unit 31 includes a sheet cassette storing a given volume of transfer sheet 25 used as recording medium. The sheet feed unit 31 feeds the transfer sheet 25 to a secondary transfer position, which is set between the secondary transfer roller 21 and the secondary-transfer counter roller 12 via the intermediate transfer belt 10. Specifically, a sheet feed roller 26, a sheet transport roller 27, and a registration roller 28 used as a registration unit feed the transfer sheet 25 to the secondary transfer position when the superimposed toner images on the intermediate transfer belt 10 comes to the secondary transfer position.

Then, the transfer sheet 25 having such transferred toner images thereon is transported to a fixing unit 30, used as fixing device or means for fixing, with a guide effect of a fixing-position-entry-side guide member 305 after the transfer sheet 25 is decharged by the above described decharger. After the toner image is fixed in the fixing unit 30, the transfer sheet 25 is ejected from the image forming apparatus 500 using an ejection roller 32. The fixing unit 30 may include a fixing roller 301 and a fixing counter roller 302 as fixing member.

In the image forming apparatus 500, the transfer sheet 25 may be transported in a upward (or vertical) direction from the registration roller 28 to the secondary transfer position, and from the secondary transfer position to the fixing unit 30. Accordingly, the image forming apparatus 500 is used as an image forming apparatus employing a vertical sheet transportation system.

The registration roller 28 may include two rollers, which face each other, in which one roller may be driven by a registration drive unit having a transmission unit for transmitting drive force. Such two rollers and registration drive unit may configure a registration unit. The registration roller 28 having two rollers may be supported by a front plate and a rear plate configuring the apparatus housing 200 of the image forming apparatus 500. Instead of such direct fixing type, the registration unit is detachably mountable to the image forming apparatus 500.

Further, the toner used in example embodiments may be polymerized toner prepared by a polymerization method, for example. Further, the toner used in example embodiments may preferably have a volume average particle diameter of 4 μm to 10 μm, for example.

Further, as shown in FIG. 1 by a dotted line, the image forming apparatus 500 has a side cover 510, which can be opened and closed. The side cover 510 is pivotable to the image forming apparatus 500 about a cover axis 510*a*.

Further, the secondary transfer unit 201 including the secondary transfer roller 21 can be supported by the side cover 510. Accordingly, when the side cover 510 is pulled out and opened from the image forming apparatus 500 as shown by a dotted line in FIG. 1, the secondary transfer unit 201 can be also pulled out with the side cover 510. As such, the secondary transfer unit 201 is detachably mountable to the image forming apparatus 500.

Further, the fixing unit 30 may be used a one integrated unit, which is detachably mountable to the image forming apparatus 500. When the side cover 510 is pulled out from the image forming apparatus 500 as shown by a dotted line in FIG. 1, the secondary transfer unit 201 can be also pulled out from the image forming apparatus 500. Then, the fixing unit 30 can be removed from the image forming apparatus 500 through an opened space.

A description is now given to a first example embodiment applied to a transportation route from the secondary transfer roller 21 and the fixing roller 301.

Figure 2:
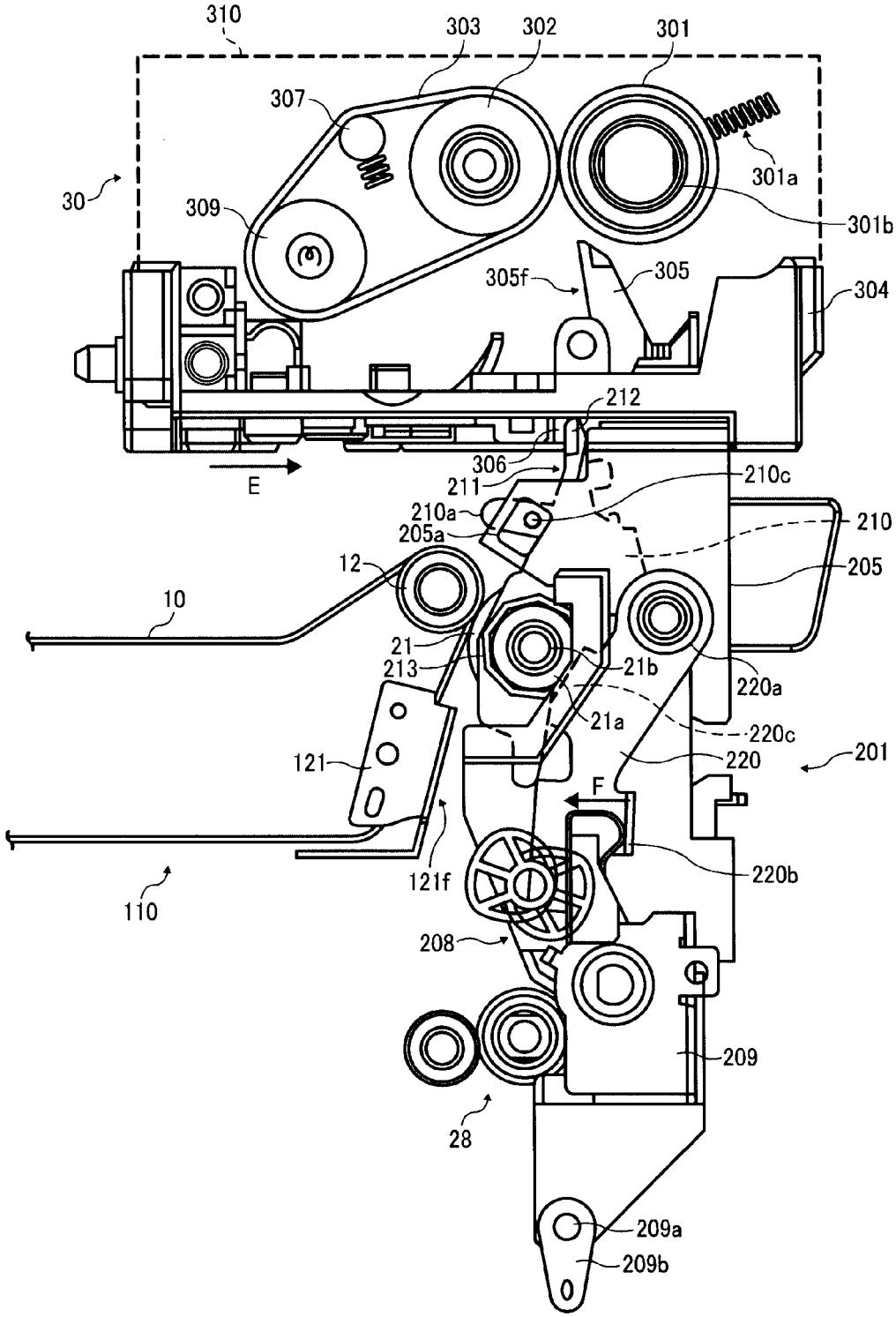
FIG. 2 illustrates a transportation route set between registration rollers and a fixing unit in the image forming apparatus of FIG. 1.

FIG. 2 illustrates a transportation route from the registration roller 28 to the fixing unit 30 in the image forming apparatus 500. As shown in FIG. 2, the transportation route from the registration roller 28 to the fixing unit 30 is disposed with the registration roller 28 (included in a registration unit), the secondary transfer unit 201 including the secondary transfer roller 21 (used as a transfer roller of secondary transfer unit), the intermediate transfer unit 110 including the intermediate transfer belt 10 (used as intermediate transfer unit), and the fixing unit 30 including the fixing roller 301.

When the registration roller 28 is driven, the transfer sheet 25 can be guided to a secondary transfer position set by the secondary transfer unit 201 and the intermediate transfer unit 110. Specifically, the secondary transfer unit 201 includes a registration-side guide face 208 disposed after the registration roller 28; and the intermediate transfer unit 110 includes a transfer-position-entry-side guide member 121 having a guide face 121*f*, disposed after the registration roller 28. The transfer-position-entry-side guide member 121 is fixed to the intermediate transfer unit 110. With such a configuration, the transfer sheet 25 fed from the registration roller 28 can be guided by the registration-side guide face 208 and the guide face 121*f* to the secondary transfer position defined by the secondary transfer roller 21 and the intermediate transfer belt 10, wherein the secondary transfer roller 21 faces the intermediate transfer belt 10 at the secondary transfer position.

The transfer sheet 25, reached to the secondary transfer position, is transferred with a toner image from the intermediate transfer belt 10. Further, because the intermediate transfer belt 10 moves in a given direction, transportation force can be applied to the transfer sheet 25, by which the transfer sheet 25 passes through the secondary transfer position.

The transfer sheet 25, passed through the secondary transfer position, is abutted to a transfer-position-exit-side guide member 211 and guided to the fixing unit 30. When reached to the fixing unit 30, the transfer sheet 25 is abutted to a guide face 305*f* of a fixing-position-entry-side guide member 305, and guided to a fixing position in the fixing unit 30.

Figure 3:
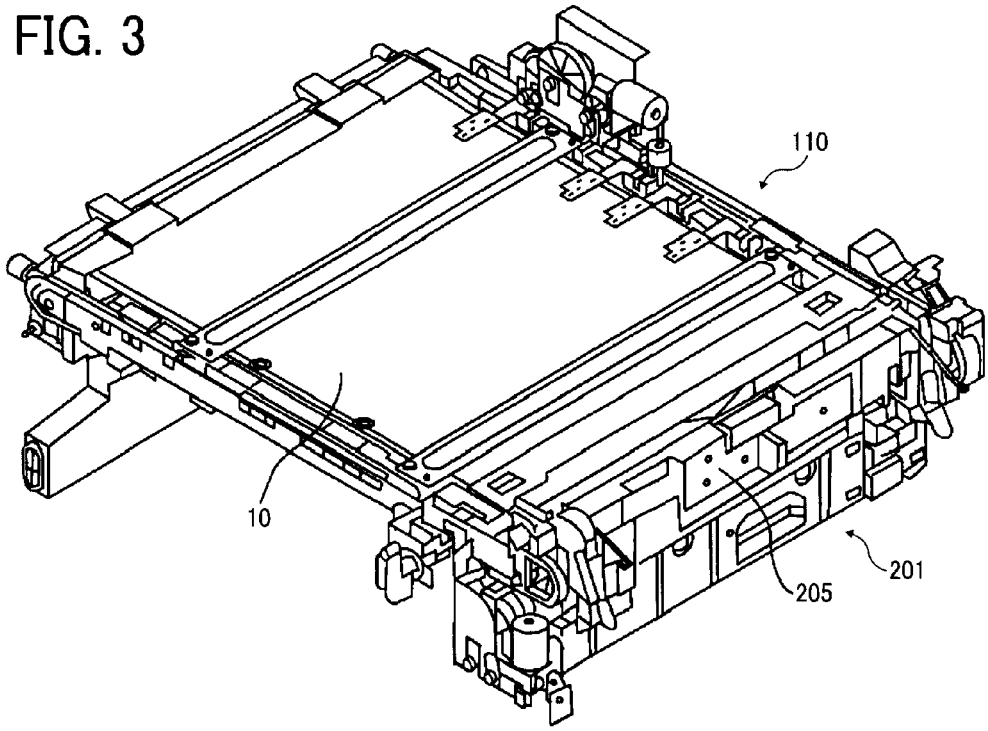
FIG. 3 illustrates a perspective view of an intermediate transfer unit and a secondary transfer unit.
Figure 4:
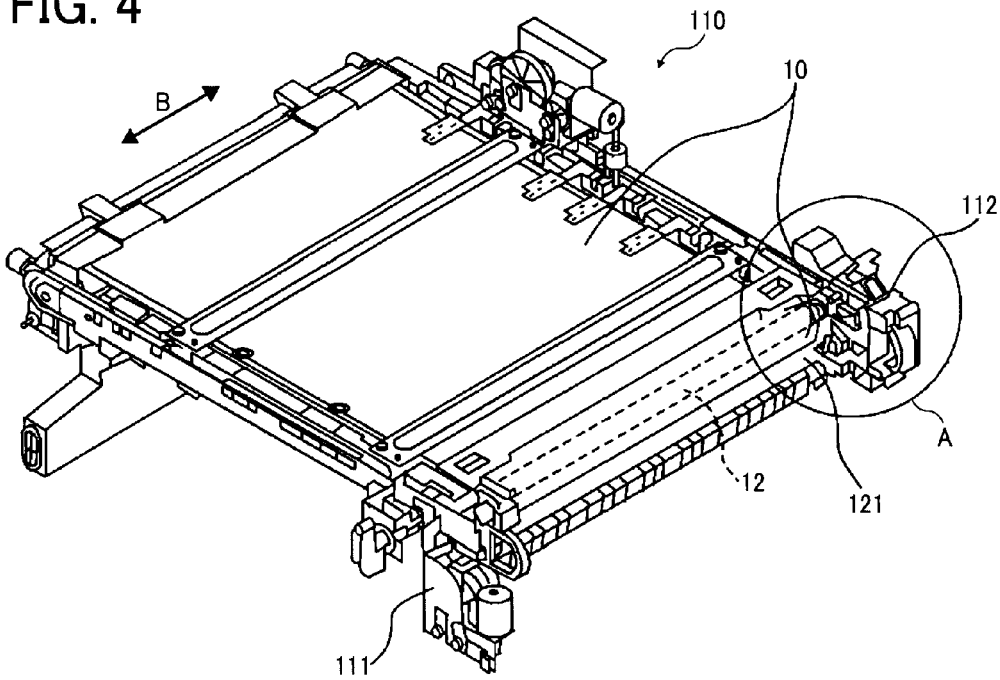
FIG. 4 illustrates a perspective view of the intermediate transfer unit.
Figure 5:
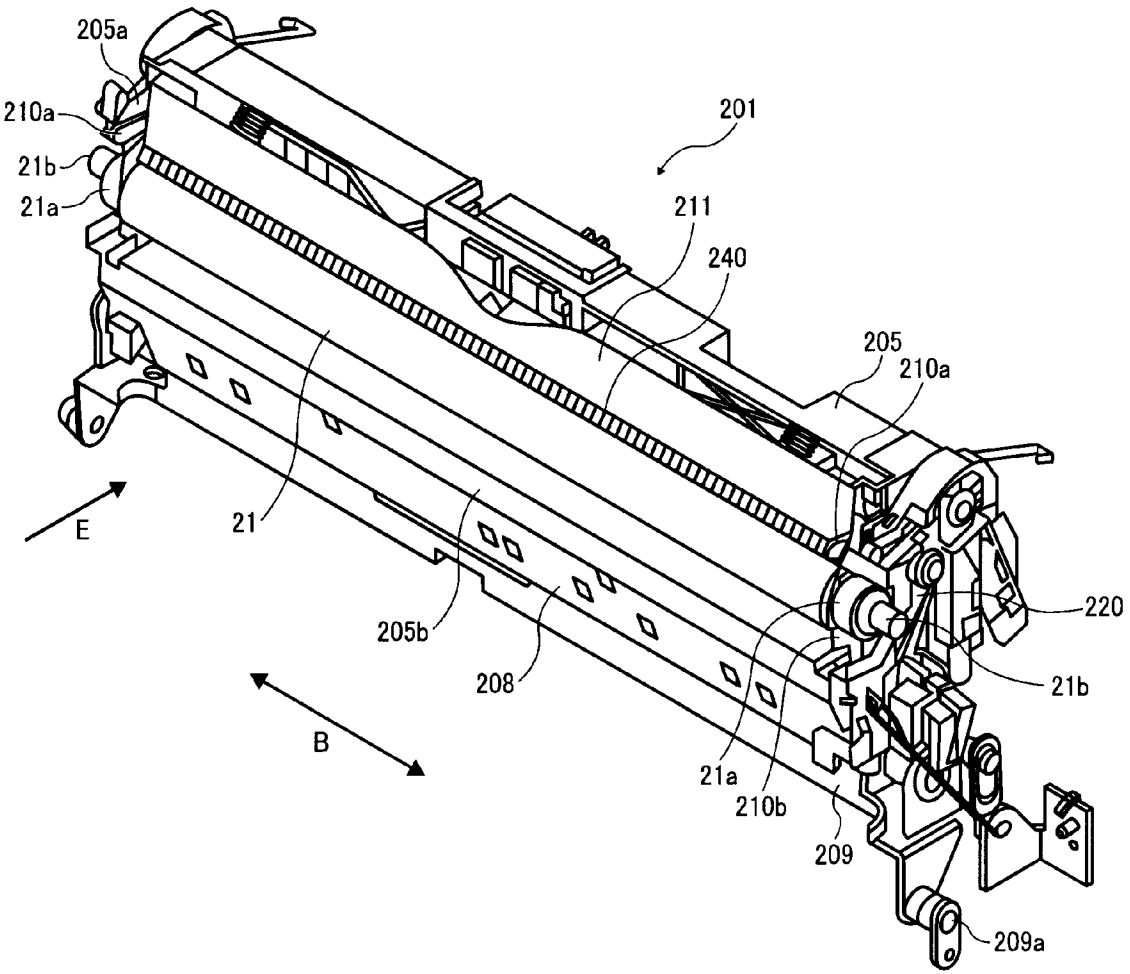
FIG. 5 illustrates a perspective view of the secondary transfer unit.
Figure 6:
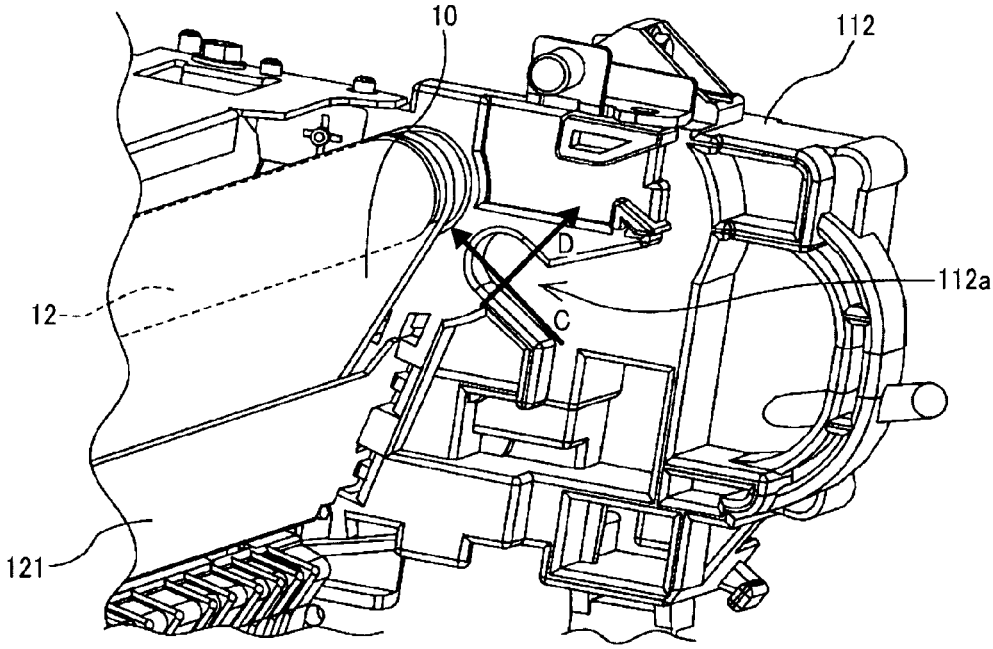
FIG. 6 illustrates an expanded view of the intermediate transfer unit at an area A of FIG. 4.

A description is now given to the secondary transfer unit 201 including the secondary transfer roller 21 with reference to drawings. FIG. 3 illustrates a perspective view of the intermediate transfer unit 110 and the secondary transfer unit 201 in the image forming apparatus 500 set at a given position, in which the secondary transfer unit 201 is set to a given position with respect to the intermediate transfer unit 110. FIG. 4 illustrates a perspective view of the intermediate transfer unit 110, and FIG. 5 illustrates a perspective view of the secondary transfer unit 201. FIG. 6 illustrates an expanded view of an area A of the intermediate transfer unit 110 shown in FIG. 4, and FIG. 7 illustrates an expanded view for a configuration of positioning the secondary transfer unit 201 to the intermediate transfer unit 110.

Figure 7:
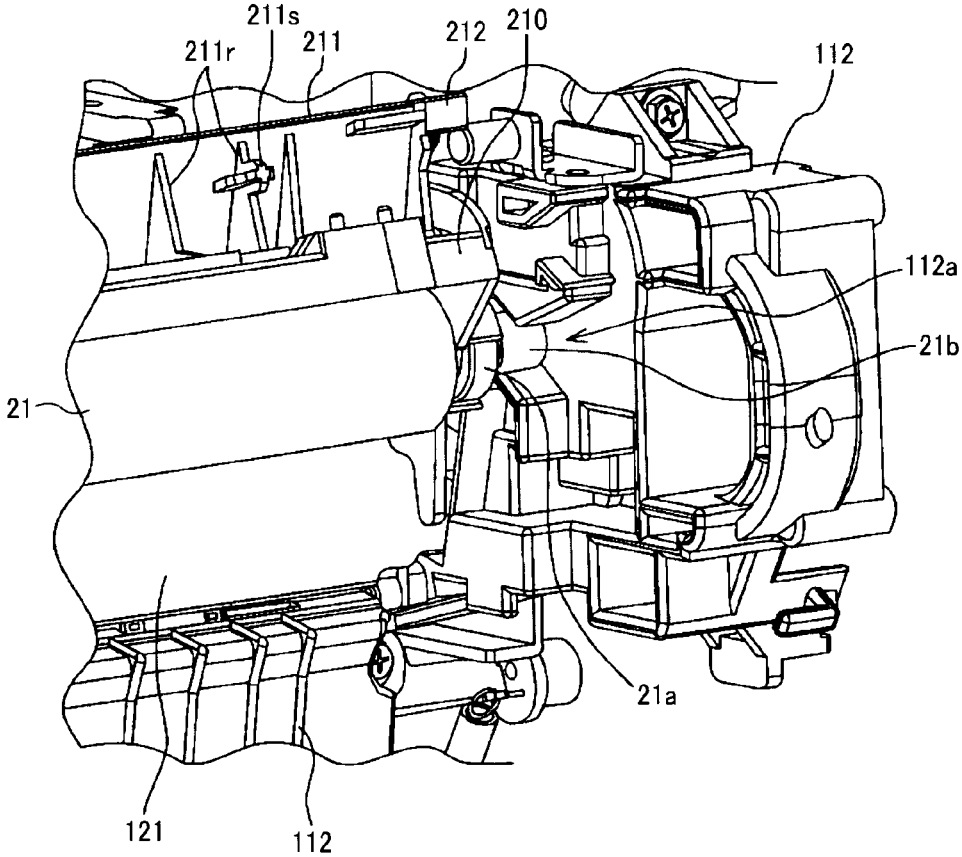
FIG. 7 illustrates a configuration of positioning of the secondary transfer unit with respect to the intermediate transfer unit.

In FIG. 7, a transfer-position-exit-side guide unit 210 having a transfer-position-exit-side guide member 211 and the secondary transfer roller 21 are shown as components of the secondary transfer unit 201, but support member of a secondary transfer roller such as a casing holder 209 and a unit casing 205 are not shown.

As shown in FIG. 2, the secondary transfer unit 201 may include the secondary transfer roller 21, the transfer-position-exit-side guide unit 210, an unit casing 205, and a casing holder 209, for example.

The transfer-position-exit-side guide unit 210 includes the transfer-position-exit-side guide member 211; the unit casing 205 supports the transfer-position-exit-side guide unit 210; and the casing holder 209 supports the unit casing 205. Further, the secondary transfer unit 201 may include a roller pressing member 220 to press the secondary transfer roller 21 to the secondary-transfer counter roller 12. The secondary transfer unit 201 may include the secondary transfer roller 21, the transfer-position-exit-side guide unit 210, the unit casing 205, the casing holder 209, and the roller pressing member 220 as one integrated unit, by which the secondary transfer unit 201 is detachably mountable to the image forming apparatus 500.

As shown in FIG. 5, the secondary transfer roller 21 has axial end portions in its axis direction (a shown by an arrow B in FIG. 5), and a transfer-roller-shaft plain bearing 21*b* is disposed at each of axial end portions. Further, a transfer-shaft ball bearing 21*a* is disposed on the transfer-roller-shaft plain bearing 21*b* for the secondary transfer roller 21. The transfer-roller-shaft plain bearing 21*b* may be disposed on a metal shaft of the secondary transfer roller 21. The transfer-roller-shaft plain bearing 21*b* may be made by a moulding process, for example.

The transfer-position-exit-side guide unit 210 includes a transfer-roller engaging member 213 and the transfer-position-exit-side guide member 211, which are integrated and fixed together by heat caulking. The transfer-roller engaging member 213 may engage with the transfer-shaft ball bearing 21*a*. Further, in the transfer-position-exit-side guide unit 210 of the first example embodiment, the transfer-roller engaging member 213 and the transfer-position-exit-side guide member 211 are fixed together by heat caulking while interposing a decharging member therebetween, which is to be described in detail later.

Further, the transfer-roller engaging member 213 may include an upper boss member 210*a* and a lower convexed member 210*b* so that the unit casing 205 supports the transfer-roller engaging member 213.

The unit casing 205 may include a roller placement support member 205*b*, and a boss engagement member 205*a*. The roller placement support member 205*b* supports the lower convexed member 210*b* from a lower side, and the boss engagement member 205*a* engages with a boss 210*c* of the upper boss member 210*a*.

Further, a lower part of the roller placement support member 205*b* of the unit casing 205 is shaped as the registration-side guide face 208, which guides the transfer sheet 25 to the secondary transfer position.

By supporting the transfer-shaft ball bearing 21*a* using the transfer-roller engaging member 213 of the transfer-position-exit-side guide unit 210, the secondary transfer roller 21 can be supported by the transfer-position-exit-side guide unit 210.

Further, when attaching the transfer-position-exit-side guide unit 210, which supports the secondary transfer roller 21, to the unit casing 205, the transfer-position-exit-side guide unit 210 is pushed in a direction shown by an arrow E in FIGS. 2 and 5 while placing the lower convexed member 210*b* on the roller placement support member 205*b*.

With such process, the boss 210*c* can contact an inside of the boss engagement member 205*a* in its axis direction (direction shown by an arrow B in FIG. 5), by which the upper boss member 210*a*, disposed at both end of axis, can be flexed to an inward direction in an axis direction of the transfer-position-exit-side guide unit 210.

Further, by pushing the transfer-position-exit-side guide unit 210 in a direction shown by an arrow E in FIG. 2 or FIG. 5, the boss 210*c* comes to a position facing an opening of the boss engagement member 205*a*, and then the boss 210*c* engages the opening the boss engagement member 205*a* because a flexed shape of the upper boss member 210*a* returns to an non-flexed shape.

With such process, the transfer-position-exit-side guide unit 210 can be supported by the unit casing 205, by which the secondary transfer roller 21 can be supported by the unit casing 205. Further, a size of the opening of boss engagement member 205*a* may be set greater than a size of the boss 210*c* as shown in FIG. 2. Accordingly, in a condition that the secondary transfer unit 201 is removed from the image forming apparatus 500, a position of the transfer-position-exit-side guide unit 210 with respect to the unit casing 205 may vary for some range due to such size configuration, wherein such range may be an range that the boss 210*c* can move within the opening of the boss engagement member 205*a*. Accordingly, when the secondary transfer unit 201 is not attached or installed in the image forming apparatus 500, the secondary transfer roller 21 may not be positioned accurately with respect to the unit casing 205.

Further, as shown in FIG. 2, the unit casing 205 includes a pivot axis 220*a*, which is used as a pivot axis of the roller pressing member 220. The roller pressing member 220 includes a tensioning member 220*b*, which can be pressed in a direction shown by an arrow F in FIG. 2 using a bias member (e.g., spring), wherein one end of the bias member is fixed to the unit casing 205 and another end of the bias member presses the tensioning member 220*b*. With such pressing force, a force which can pivot the roller pressing member 220 about the pivot axis 220*a* can be applied.

When the secondary transfer unit 201 is installed in the image forming apparatus 500, a ball-bearing pressing member 220*c* of the roller pressing member 220 contacts the transfer-shaft ball bearing 21*a*, and the ball-bearing pressing member 220*c* presses the transfer-shaft ball bearing 21*a* toward the secondary-transfer counter roller 12. With such a configuration, the secondary transfer roller 21 can be faced to the secondary-transfer counter roller 12 by interposing the intermediate transfer belt 10 therebetween.

Further, the casing holder 209 may be made of a sheet-metal, and the unit casing 205 may be made of resin material. Then, the casing holder 209 and the unit casing 205 may be fixed together using screws.

Further, by fixing a unit fixing member 209*b* of the casing holder 209 to the side cover 510, the secondary transfer unit 201 can be supported by the side cover 510. When the unit fixing member 209*b* is fixed to the side cover 510, the secondary transfer unit 201 can be pivot about a unit pivot axis 209*a* with respect to the side cover 510 when the side cover 510 is opened as shown by a dotted line in FIG. 1.

When the side cover 510 is closed from the opened position, an internal face of the side cover 510 presses a unit bias member such as spring disposed for the unit casing 205, by which the secondary transfer unit 201 pivots with the side cover 510, and set in the image forming apparatus 500. When the side cover 510 is closed, a part of the unit casing 205 or the casing holder 209 may abut with some internal components of the image forming apparatus 500, an such abutting and a biasing force of the unit bias member may be used to set and position the unit casing 205 at a given position in the image forming apparatus 500.

As shown in FIG. 4, the intermediate transfer unit 110 may include a front frame 111 and a rear frame 112, for example. The front and rear frames 111 and 112 are disposed at an end of the axis direction (direction shown by an arrow B in FIG. 4) of roller, which extends and tensions the intermediate transfer belt 10. Further, as shown in FIG. 6, the rear frame 112 includes a concaved section 112*a* on an inside face of the rear frame 112, which is perpendicular to the axis direction. The concaved section 112*a* may have an opening as shown in FIG. 6. Further, the front frame 111 includes a similar concaved section on an inside face of the front frame 111, which is perpendicular to the axis direction.

As shown in FIG. 7, the transfer-roller-shaft plain bearing 21*b* is fit in the concaved section 112*a* of the rear frame 112 and the concaved section of the front frame 111. By fitting the transfer-roller-shaft plain bearing 21*b* in the concaved section, a position of the secondary transfer roller 21 with respect to the intermediate transfer unit 110 in a direction shown by an arrow D in FIG. 6 can be set to a given position.

Further, because the secondary transfer roller 21 is abutted to the secondary-transfer counter roller 12 by interposing the intermediate transfer belt 10 therebetween by using the roller pressing member 220, a position of the secondary transfer roller 21 with respect to the intermediate transfer unit 110 in a direction shown by an arrow C in FIG. 6 can be set to a given position. As such, by fitting the transfer-roller-shaft plain bearing 21*b* in the concaved section, a position of the secondary transfer roller 21 with respect to the intermediate transfer unit 110 can be set to a given position.

Further, in the image forming apparatus 500, the secondary transfer unit 201 is fixed to the side cover 510. Accordingly, when the side cover 510 is closed, the transfer-roller-shaft plain bearing 21*b* can be fit in the concaved section, by which a position of the secondary transfer roller 21 with respect to the intermediate transfer unit 110 can be set to a given position, wherein the intermediate transfer unit 110 is fixed to a given position in the image forming apparatus 500.

Accordingly, by fixing the secondary transfer unit 201 to the side cover 510 and closing the side cover 510, a position of the secondary transfer roller 21 with respect to the apparatus housing 200 of the image forming apparatus 500 can be set to a given position, and a position of the unit casing 205 with respect to the apparatus housing 200 of the image forming apparatus 500 can be set to a given position. Accordingly, by installing the secondary transfer unit 201 in the image forming apparatus 500, a position of the secondary transfer roller 21 with respect to the unit casing 205 can be set to a given position.

As above described, in the image forming apparatus 500, the secondary transfer roller 21 is fixed to the concaved section formed on the front frame 111 and the rear frame 112, by which the secondary transfer roller 21 is fixed to the apparatus housing 200 of the image forming apparatus 500. Accordingly, a position of the secondary transfer roller 21 in the image forming apparatus 500 may fluctuate among finished products (e.g., image forming apparatus 500) because each component has variation on size as tolerance, and such variation may become added-tolerances, which may be different among finished products.

Further, in the image forming apparatus 500, the secondary transfer roller 21 may be pressed to the secondary-transfer counter roller 12 with a given pressure. For example, the secondary transfer roller 21 is pressed to the secondary-transfer counter roller 12 with a high pressure such as 50 N (newton) or more, and preferably 100 N so that a nip pressure at the secondary transfer position (or secondary transfer nip) can be set to a high pressure.

However, such nip pressure may cause deformation of components in the intermediate transfer unit 110 and the secondary transfer unit 201. For example, due to such nip pressure, the secondary transfer roller 21 causes deformation to components in the intermediate transfer unit 110, which is abutted via the transfer-roller-shaft plain bearing 21*b*; the secondary transfer roller 21 causes deformation to components in the secondary transfer unit 201 via the transfer-shaft ball bearing 21*a*, wherein the secondary transfer unit 201 includes the roller pressing member 220 to press the secondary transfer roller 21. Further, deformation may occur to support members supporting the intermediate transfer unit 110 and the secondary transfer unit 201. Further, such deformation of components caused by the nip pressure may vary among finished products of the image forming apparatus 500, and such variation of deformation of components may cause variation of positions of the secondary transfer roller 21 with respect to the image forming apparatus 500 among finished products.

A description is now given to the fixing unit 30 including the fixing roller 301 with reference to FIG. 2. As shown in FIG. 2, the fixing unit 30 may include a fixing roller 301, a fixing belt 303, a fixing-position-entry-side guide member 305, a fixing-unit bottom plate 304, and a fixing-unit side plate 310, for example. The fixing belt 303 is extended by a fixing counter roller 302, a heat roller 309, and a fixing belt tension roller 307. The fixing counter roller 302 may be used as a drive roller. By driving fixing counter roller 302, the fixing belt 303 moves endlessly in a given direction. The fixing roller 301 is pressed by a fixing roller pressing member 301*a* (e.g., spring) and abutted to the fixing counter roller 302 interposing the fixing belt 303 therebetween, by which a fixing position (or fixing nip) is formed.

The fixing counter roller 302 and the heat roller 309 are fixed to the fixing-unit side plate 310, and the fixing roller 301 is abutted to the fixing counter roller 302 using the fixing roller pressing member 301*a*. Accordingly, a position of the fixing roller 301 with respect to the fixing-unit side plate 310 can be set to a given position via the fixing counter roller 302.

Further, the fixing-position-entry-side guide member 305 is fixed to the fixing-unit bottom plate 304. The fixing-unit side plate 310 may be made of a sheet-metal, and the fixing-unit bottom plate 304 may be made of resin material using a moulding method, and the fixing-unit side plate 310 is fixed to the fixing-unit bottom plate 304 using screws (not shown).

With the above-described configuration, relative positions of components configuring the fixing unit 30 can be substantially fixed to given positions with respect to the fixing roller 301.

However, the fixing unit 30 is detachably mountable to the image forming apparatus 500 as one unit. Accordingly, positions of the fixing-unit side plate 310 and the fixing-unit bottom plate 304 configuring a casing of the fixing unit 30 with respect to the apparatus housing 200 of the image forming apparatus 500 may fluctuate among finished products of the image forming apparatus 500. Accordingly, relative position of the fixing roller 301, fixed to the fixing-unit side plate 310 and fixing-unit bottom plate 304, and the apparatus housing 200 of the image forming apparatus 500 may fluctuate among finished products of the image forming apparatus 500.

As above described, relative position of the secondary transfer roller 21 or relative position of the fixing roller 301 with respect to the apparatus housing 200 of the image forming apparatus 500 may fluctuate. If such instability occurs at least one of the secondary transfer roller 21 and the fixing roller 301, the relative position of the secondary transfer roller 21 and the fixing roller 301 may fluctuate.

If the relative position of the secondary transfer roller 21 or fixing roller 301 may deviate from a preferred relative position, a relative position of the secondary transfer roller 21 with respect to the transfer-position-exit-side guide member 211, or a relative position of the fixing roller 301 with respect to the transfer-position-exit-side guide member 211 may deviate from a preferred relative position.

If the relative position of the secondary transfer roller 21 with respect to the transfer-position-exit-side guide member 211, or the relative position of the fixing roller 301 with respect to the transfer-position-exit-side guide member 211 may deviate from a preferred relative position, sheet transporting performance from the secondary transfer position to the fixing position may degrade. If sheet transporting performance from the secondary transfer position to the fixing position may degrade, problems may occur to sheet transported in the transportation route. For example, wrinkles may occur on the transfer sheet; sheet jamming may occur in a sheet transportation route between the secondary transfer position and the fixing position.

Figure 8:
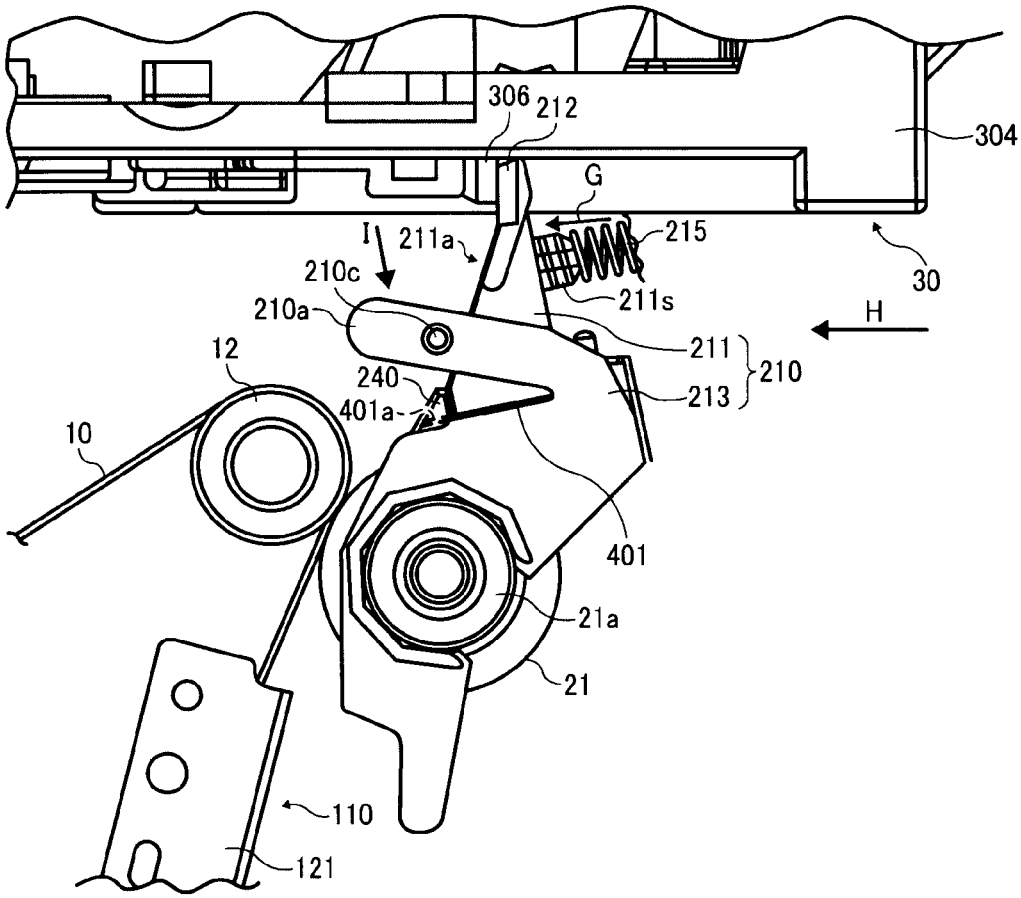
FIG. 8 illustrates a configuration of positioning of secondary-transfer-position-exit-side guide member for the first example embodiment.

A description is now given to a configuration for positioning the transfer-position-exit-side guide unit 210 at a given position according to the first example embodiment with reference to FIG. 8. As shown in FIG. 8, the transfer-position-exit-side guide unit 210 includes the transfer-position-exit-side guide member 211 having a guide contact portion 212 at the downstream side of sheet transport direction of the transfer sheet 25. Such guide contact portion 212 is abutted to an abutting portion 306 formed on the fixing-unit bottom plate 304 of the fixing unit 30. With such a configuration, a position of the transfer-position-exit-side guide unit 210 with respect to the fixing unit 30 can be set to a given position.

Further, at the upstream side of sheet transport direction of the transfer sheet 25, the transfer-position-exit-side guide unit 210 includes the transfer-roller engaging member 213, which is fittable to the transfer-shaft ball bearing 21*a*, wherein a relative position of the transfer-shaft ball bearing 21*a* with respect to the secondary transfer roller 21 is substantially fixed. Accordingly, a position of the transfer-position-exit-side guide unit 210 with respect to the secondary transfer roller 21 can be set to a given position.

As above described, a relative position of the transfer-position-exit-side guide unit 210 with respect to the secondary transfer roller 21 (disposed at the upstream side of sheet transport direction) is set to a given position, and a relative position of the transfer-position-exit-side guide unit 210 with respect to the fixing unit 30 (disposed at the downstream side of sheet transport direction) is set to a given position. Under such configuration, even if a relative position of the secondary transfer roller 21 and the fixing roller 301 may deviate from a preferred position, the relative position of the secondary transfer roller 21 and the fixing roller 301 with respect to the transfer-position-exit-side guide member 211 can be maintained at a preferred position.

As above described, the transfer-shaft ball bearing 21*a*, used as a bearing of the secondary transfer roller 21, is used as a component to set a reference position for positioning, wherein the transfer-shaft ball bearing 21*a* may be manufactured with a higher precision because of its required functionality. Accordingly, by setting a relative position of the transfer-position-exit-side guide unit 210 based on such component having higher precision, positioning precision can be enhanced.

With such a configuration, sheet transporting performance between the secondary transfer position and the fixing position can be enhanced, by which problems related to sheet transportation can be reduced. For example, wrinkles may not occur on the transfer sheet, and sheet jamming may not occur in the transportation route between the secondary transfer position and the fixing position.

In a conventional image forming apparatus, a position of transfer-position exit-side guide member is set with respect to a secondary transfer unit. Under such condition, added tolerance of components disposed from a secondary transfer roller to the transfer-position exit-side guide member may fluctuate, by which a relative position of transfer-position exit-side guide member with respect to the secondary transfer roller may not be maintained at a higher precision. Further, if a position of the secondary transfer roller with respect to a casing of the secondary transfer unit is deviated, or if a position of the secondary transfer roller is deviated from a given designed position, a relative position of transfer-position exit-side guide member with respect to the secondary transfer roller may not be maintained at a higher precision. Such problems can be solved using the configuration according to the first example embodiment.

Further, in the first example embodiment, two guide units or members (i.e., transfer-position-exit-side guide unit 210 and fixing-position-entry-side guide member 305) are disposed between the secondary transfer roller 21 and the fixing roller 301. However, instead of using two guide members, only one guide member may be disposed between the secondary transfer roller 21 and the fixing roller 301. In such a case, a shape and installation position of one guide member may have functions, which can be realized by using two guide members.

In the first example embodiment, a part of the transfer-position-exit-side guide unit 210 is abutted to the abutting portion 306 of the fixing-unit bottom plate 304 of the fixing unit 30 to set the transfer-position-exit-side guide unit 210 at a given position. However, a part of the transfer-position-exit-side guide unit 210 can be abutted to another part. For example, a part of the transfer-position-exit-side guide unit 210 can be abutted to a shaft of the fixing roller 301, a casing of the fixing unit 30, the fixing-position-entry-side guide member 305 of the fixing unit 30, and a shaft of the roller extending the fixing belt 303, or other parts configuring the fixing unit 30.

Further, in the first example embodiment, relative position of components configuring the fixing unit 30 with respect to the fixing roller 301 may be substantially fixed.

In such configuration, some components of the fixing unit 30 may have smaller strength, and relative position of such components with respect to the fixing roller 301 may change for some level. Then, a part of the transfer-position-exit-side guide unit 210 may be abutted to such components. Even in such abutting configuration, a relative position of such components with respect to the transfer-position-exit-side guide unit 210 can be maintained at a given level. Accordingly, sheet transporting performance from the secondary transfer position to the fixing position can be enhanced compared to a configuration that the transfer-position-exit-side guide unit 210 is not properly positioned with respect to the fixing unit 30.

Figure 9:
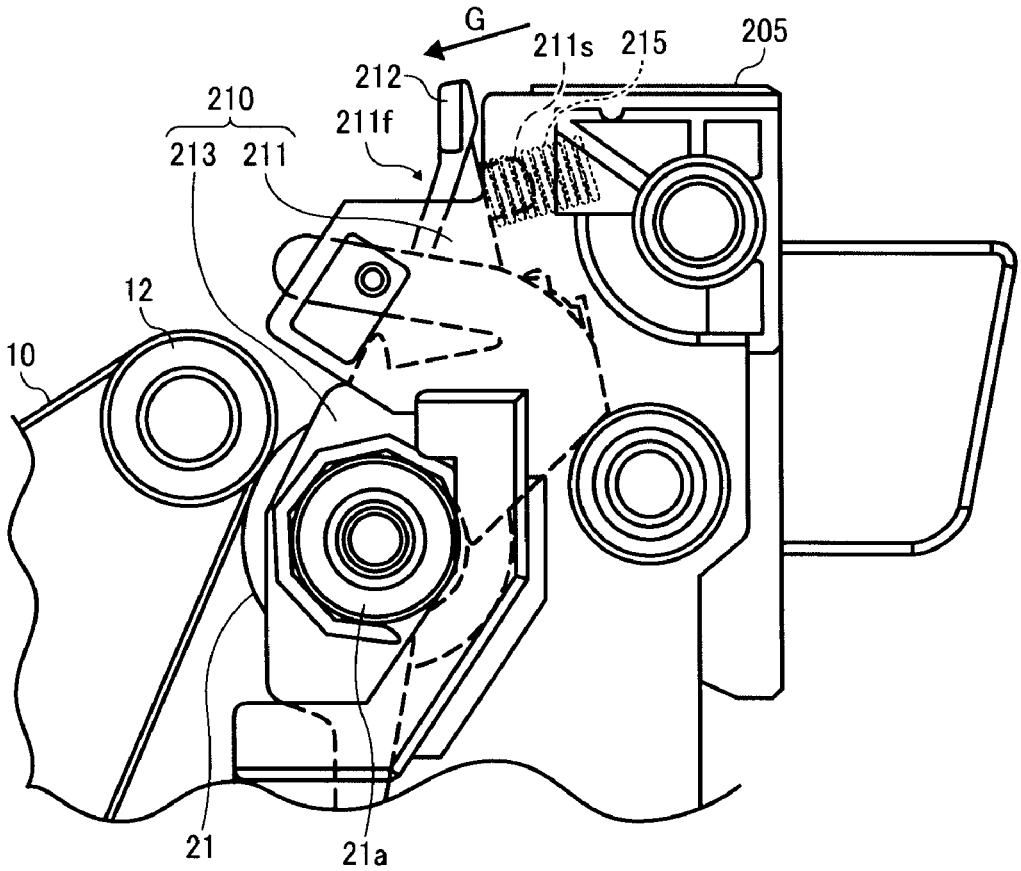
FIG. 9 illustrates an expanded view of the secondary transfer unit of FIG. 2, which is near a secondary-transfer-position-exit-side exit-side guide member.

A description is now given to a configuration of abutting the guide contact portion 212 of the transfer-position-exit-side guide member 211 to the abutting portion 306 of the fixing-unit bottom plate 304 with reference to FIG. 9. FIG. 9 illustrates an expanded view of the transfer-position-exit-side guide unit 210 of the secondary transfer unit 201 shown in FIG. 2. In FIG. 9, the fixing unit 30 and the roller pressing member 220 are omitted. As shown in FIG. 9, a spring-engaging convex member 211*s* is formed on a backside of a transfer-position-exit-side guide face 211*f* of the transfer-position-exit-side guide member 211.

Further, an exit-side guide biasing spring 215, used as a biasing member is disposed as below. Specifically, one end of the exit-side guide biasing spring 215 is fixed to the unit casing 205, and other end of the exit-side guide biasing spring 215 is engaged to the spring-engaging convex member 211*s*. With such configuration, the exit-side guide biasing spring 215 biases the transfer-position-exit-side guide unit 210 to the unit casing 205 in a direction shown by an arrow G of FIG. 9 or 8.

The transfer-position-exit-side guide unit 210 is engaged with the transfer-shaft ball bearing 21*a*. By biasing the transfer-position-exit-side guide unit 210 in a direction shown by an arrow G (see FIG. 9) using the exit-side guide biasing spring 215, a force can be applied to the transfer-position-exit-side guide unit 210 in a counter-clockwise direction in FIG. 9 about a rotary shaft of the secondary transfer roller 21, by which the guide contact portion 212 of the transfer-position-exit-side guide unit 210 can be abutted to the abutting portion 306 of the fixing-unit bottom plate 304.

In such configuration, when the secondary transfer unit 201 is set and installed in the image forming apparatus 500, the exit-side guide biasing spring 215 is pressed between the transfer-position-exit-side guide unit 210 and the unit casing 205, by which the exit-side guide biasing spring 215 is shrinked from a natural length of spring. Then, restoring force of the shrinked exit-side guide biasing spring 215 is used to bias the transfer-position-exit-side guide unit 210, by which the guide contact portion 212 can be abutted to the abutting portion 306, and then a position of the transfer-position-exit-side guide unit 210 with respect to the fixing unit 30 can be set to given position. The biasing force of the exit-side guide biasing spring 215 may be set to 4 N (Newton) at one side, for example. Based on experiment, transportation of thick sheet can be conducted in a stable manner if the biasing force of the exit-side guide biasing spring 215 is set 2 N (Newton) or more at one side.

Further, the upper limit of the biasing force of the exit-side guide biasing spring 215 can be determined in view of deformation of guide members. If deformation of guide member exceeds 1 mm, wrinkles occur on a thin sheet. If deformation of guide member is between 1 mm to 0.5 mm, wrinkles may occur on a thin sheet. Accordingly, deformation of guide member may be preferably set to 0.5 mm or less as design value of apparatus on rare occasions.

As shown in FIG. 9, a guide unit or member (e.g., transfer-position-exit-side guide unit 210) is positioned between given units (e.g., secondary transfer unit 201 and fixing unit 30). Accordingly, the guide member is positioned at given positions using two end positions of the guide member. In such configuration, one end of the guide member may be positioned using pressure of a spring as shown in FIG. 9. If such spring-used positioning mechanism is used, units can be easily detached from an apparatus while enhancing sheet transporting performance of the transfer sheet 25.

Specifically, a relative position of the transfer-position-exit-side guide unit 210 with respect to the fixing unit 30 can be set by biasing the transfer-position-exit-side guide unit 210 in a direction shown by an arrow G in FIG. 9. Accordingly, by moving the secondary transfer unit 201 in one direction with respect to the fixing unit 30, which is opposite to the direction shown by an arrow G, engagement of the transfer-position-exit-side guide unit 210 with respect to the fixing unit 30 can be canceled.

In the first example embodiment, when the side cover 510 is opened as shown by a dotted line in FIG. 1, the secondary transfer unit 201 can be moved in one direction, which is opposite to the direction shown by an arrow G, by which a positional engagement of the transfer-position-exit-side guide unit 210 with respect to the fixing unit 30 can be canceled. Such configuration that can cancel the engagement of the transfer-position-exit-side guide unit 210 with respect to the fixing unit 30 by opening the side cover 510 may be preferable compared to a configuration that both end of the transfer-position-exit-side guide unit 210 are respectively engaged to a bearing of the secondary transfer roller 21 and a bearing of the fixing roller 301. For example, in the above-described configuration according to the first example embodiment, detachability of the secondary transfer unit 201 and the fixing unit 30 from the image forming apparatus 500 can be enhanced while maintaining sheet transporting performance of the transfer sheet 25. Such configuration to set a guide member at a given position using a biasing member can be applied to any guide member other than the transfer-position-exit-side guide unit 210.

Figure 10:
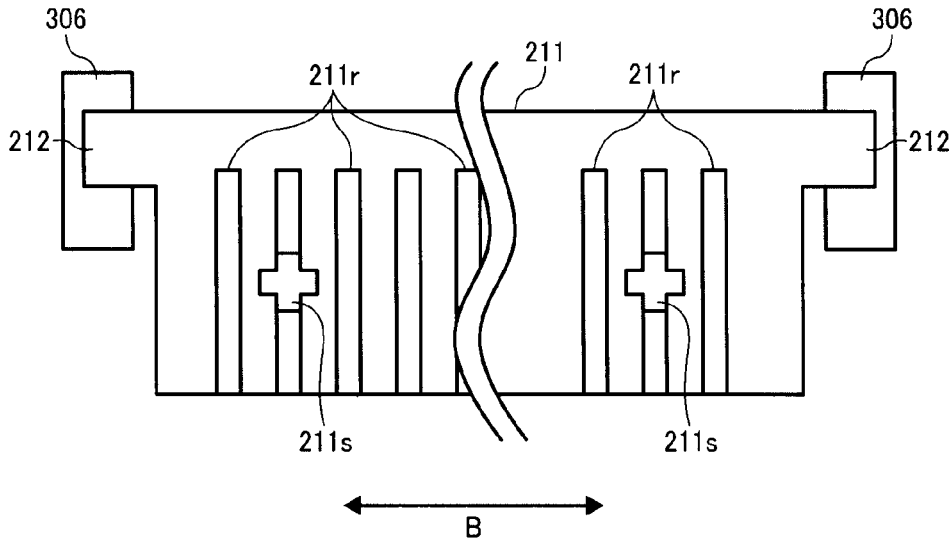
FIG. 10 illustrates a schematic view of secondary-transfer-position-exit-side guide member viewed from a direction shown by an arrow H in FIG. 8.

FIG. 10 illustrates the transfer-position-exit-side guide member 211, which is viewed from a direction shown by an arrow H in FIG. 8. As shown in FIGS. 7 and 10, the guide contact portion 212 is provided at both end portion of the transfer-position-exit-side guide member 211 in its width direction (direction shown by an arrow B in FIG. 10). Further, the spring-engaging convex member 211*s* is provided at inner side from the both end portion of the transfer-position-exit-side guide member 211, wherein the spring-engaging convex member 211*s* is applied with biasing force of the exit-side guide biasing spring 215.

If the guide contact portion 212 and the spring-engaging convex member 211*s* are formed on different positions as such, there may be a concern that the transfer-position-exit-side guide member 211 may deform. For example, the transfer-position-exit-side guide face 211*f*, which is an opposite side face of the spring-engaging convex member 211*s*, may expand.

If a part of the transfer-position-exit-side guide face 211*f* expands and deforms, sheet transporting performance of the transfer sheet 25 at the transfer-position-exit-side guide member 211 may degrade, by which sheet jamming may occur.

In view of such problem, in the first example embodiment, a plurality of transfer-position exit-side guide ribs 211*r* are formed on a back face of the transfer-position-exit-side guide face 211*f* of the transfer-position-exit-side guide member 211. With such a configuration, deformation (e.g., partial expansion) of the transfer-position-exit-side guide face 211*f* of the transfer-position-exit-side guide member 211 may be prevented.

Further, if a positional instability in the fixing unit 30 with respect to the secondary transfer roller 21 may occur in a rotation direction of rotary shaft of the secondary transfer roller 21, the transfer-position-exit-side guide member 211 having a property of hard-to-deform can be employed as the first example embodiment.

A position of the guide contact portion 212 and a position of the spring-engaging convex member 211*s* may not match in some case. However, even in such situation, if the transfer-position-exit-side guide member 211 has a property of hard-to-deform, deformation that causes degradation of sheet transporting performance of the transfer-position-exit-side guide member 211 may be hard to occur, by which a greater number of layout patterns can be devised.

However, a positional instability in the fixing unit 30 with respect to the secondary transfer roller 21 may not limited in a rotation direction of rotary shaft of the secondary transfer roller 21. For example, positional instability may occur between a rotary shaft of the secondary transfer roller 21 and a rotary shaft of the fixing roller 301 included in the fixing unit 30, in which relative position of rotary shaft of the secondary transfer roller 21 and rotary shaft of the fixing unit 30 may be twisted.

Figure 11:
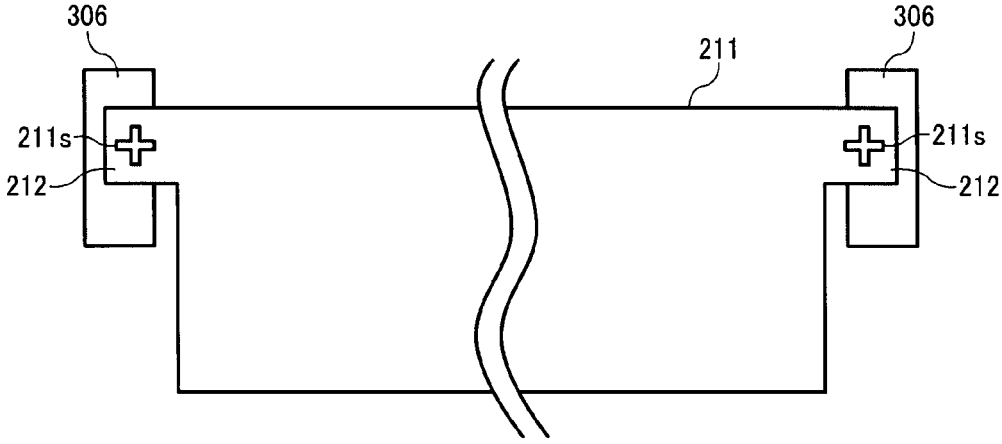
FIG. 11 illustrates another example of secondary-transfer-position-exit-side guide member.

In view of such situation, another example of the transfer-position-exit-side guide member 211 is devised as shown in FIG. 11. The transfer-position-exit-side guide member 211 shown in FIG. 11 is not formed with the transfer-position exit-side guide ribs 211*r*, which is different from the transfer-position-exit-side guide member 211 shown in FIG. 10. In FIG. 11, the transfer-position-exit-side guide member 211 can be deformed and twisted for some level with respect to an upstream end side and downstream end side of the transfer-position-exit-side guide member 211.

In FIG. 11, the transfer-position-exit-side guide member 211 has no transfer-position exit-side guide ribs 211*r*, but a position of the guide contact portion 212 and a position of the spring-engaging convex member 211*s* are matched as shown in FIG. 11, by which deformation of the transfer-position-exit-side guide member 211, which may be caused by a biasing configuration abutting a part of the transfer-position-exit-side guide member 211 to the fixing unit 30, can be prevented.

As such, deformation of the transfer-position-exit-side guide member 211 caused by a biasing configuration can be prevented. Further, because the transfer-position-exit-side guide member 211 is not provided with the transfer-position exit-side guide ribs 211*r*, the transfer-position-exit-side guide member 211 can be twisted for some level at an upstream end side and downstream end side of the transfer-position-exit-side guide member 211. Accordingly, even if a relative positions of the rotary shaft of the secondary transfer roller 21 and the rotary shaft of the fixing roller 301 may fluctuate in the twisting direction, a relative position of the transfer-position-exit-side guide member 211 with respect to the secondary transfer roller 21, and a relative position of the transfer-position-exit-side guide member 211 with respect to the fixing roller 301 can be maintained. With such a configuration, the guide member can follow some positional deviation caused by added tolerance or positional instability, and thereby the guide member can follow such positional deviation with enhanced manner, and sheet transporting performance from the secondary transfer position to the fixing position can be maintained at a preferable level.

The transfer-position-exit-side guide member 211, which can be deformed and twisted for some level at the upstream and downstream end sides of the transfer-position-exit-side guide member 211, may be made of a resin material using a moulding method, or may be made of a thin sheet-metal.

Further, the guide member, which can be deformed and twisted for some level at the upstream and downstream end sides of the guide member, may not limited to the transfer-position-exit-side guide unit 210. For example, a guide member, disposed at a position between a upstream-side unit and a downstream-side unit, may be set to have such deforming property so that sheet transporting performance at or near the guide member can be enhanced. Such guide members may be a fixing-position-entry-side guide member, a transfer-position-entry-side guide member, or the like, to be described later.

As above described, as for the transfer-position-exit-side guide unit 210, the transfer-roller engaging member 213 and the transfer-position-exit-side guide member 211 are fixed together by heat caulking, and a decharging member 401 may be disposed between the transfer-roller engaging member 213 and the transfer-position-exit-side guide member 211.

Figure 12:
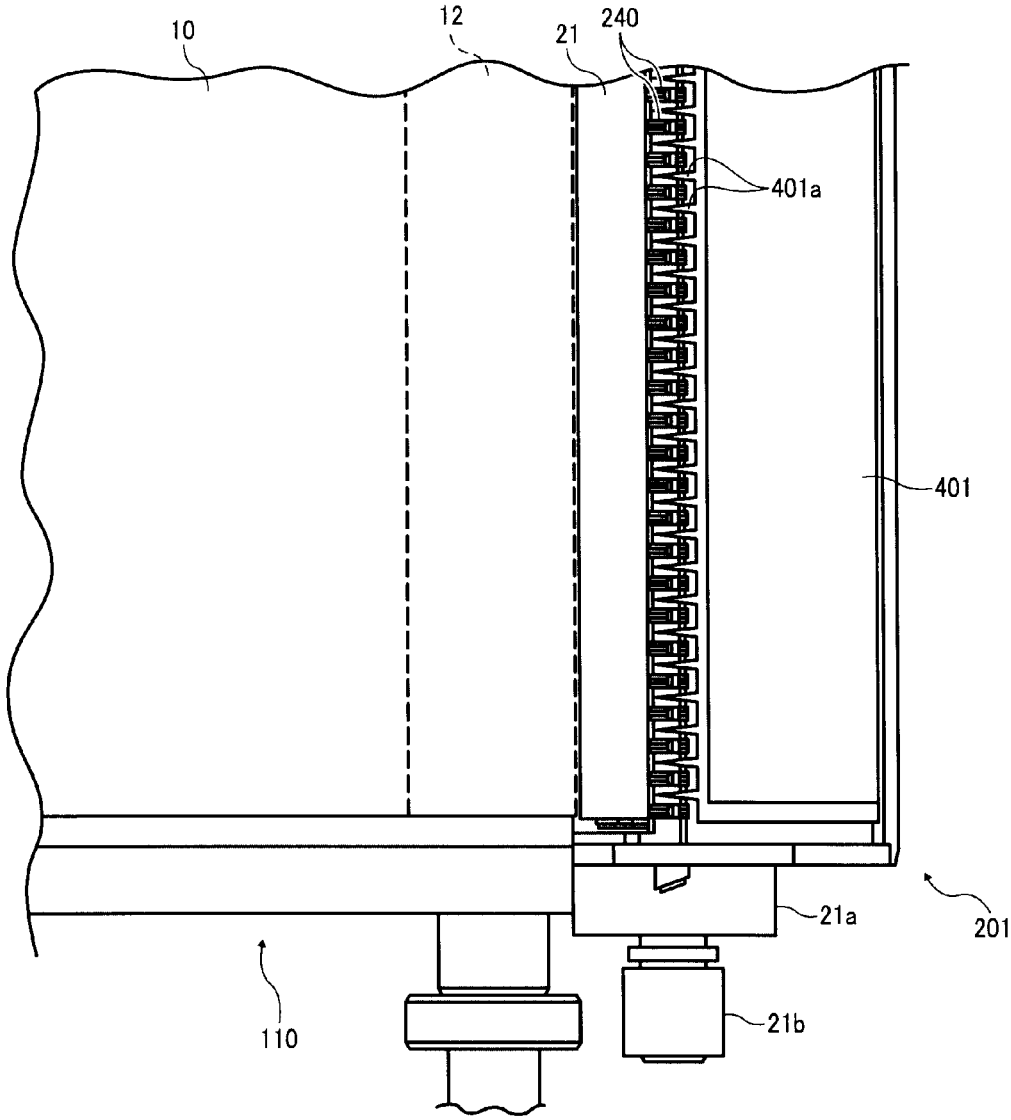
FIG. 12 illustrates an expanded view near a secondary transfer position set between the intermediate transfer unit and secondary transfer unit.

FIG. 12 shows a partial view near the secondary transfer position, set between the intermediate transfer unit 110 and the secondary transfer unit 201. In FIG. 12, the secondary transfer position is viewed from a direction shown by an arrow I in FIG. 8 by omitting the transfer-position-exit-side guide member 211 from the secondary transfer unit 201. As shown in FIGS. 12 and 8, the decharging member 401 includes a plurality of decharging needles 401*a*. Further, a plurality of decharging position guide ribs 240 formed on the transfer-roller engaging member 213.

Specifically, when the transfer sheet 25 passes the secondary transfer position, the transfer sheet 25 may face the transfer-roller engaging member 213, and also face the decharging needles 401*a* of the decharging member 401. The plurality of decharging position guide ribs 240 are formed along a rotation axis direction of the secondary transfer roller 21. The decharging needles 401*a*, sandwiched between the transfer-roller engaging member 213 and the transfer-position-exit-side guide member 211, may protrude between adjacent decharging position guide ribs 240 so that leading edge of decharging needles 401*a* can be positioned near a transport position of the transfer sheet 25.

To enhance sheet transporting performance of the transfer sheet 25, separation performance of the transfer sheet 25 from the intermediate transfer belt 10 may need to be considered.

When the transfer sheet 25 passes the secondary transfer position, the transfer sheet 25 may have a given level of charge. If the transfer sheet 25 retains such charged condition, the transfer sheet 25 may be electrostatically adsorbed on the intermediate transfer belt 10, by which the transfer sheet 25 cannot be separated from the intermediate transfer belt 10. If such adsorption occurs, the transfer sheet 25 may not be transported accurately in the transportation route, by which sheet jamming may occur. In view of such problem, the transfer sheet 25 is set to a decharged condition by approximating the decharging needles 401*a* to the transfer sheet 25, which has passed the secondary transfer position. In such configuration, a relative positions of the leading edge of the decharging needles 401*a* and the transfer sheet 25 passing through the decharging position guide ribs 240 may need to be set to given value.

If the leading edge of decharging needles 401*a* is too close to the transfer sheet 25 and contacts the passing transfer sheet 25, the transfer sheet 25 may be caught by the decharging needles 401*a*, by which sheet jamming may occur. Further, even if the transfer sheet 25 is not caught by the decharging needles 401*a*, un-fixed toner image on the transfer sheet 25 may be sputtered by a contact impact of the decharging needles 401*a* to the transfer sheet 25, by which an image failure such as image sputtering may occur.

Further, if the leading edge of decharging needles 401*a* is too close to the transfer sheet 25 while not contacting the transfer sheet 25, un-fixed toner image on the transfer sheet 25 may be sputtered, by which an image failure may occur. For example, the image failure having unintended lines corresponding to position of the decharging needles 401*a* may occur.

Further, if the leading edge of decharging needles 401*a* is too far from the transfer sheet 25, the transfer sheet 25 may not be decharged, by which the transfer sheet 25 may not be separated from the intermediate transfer belt 10 effectively, and thereby sheet jamming may occur.

Conventionally, a decharging member may be disposed at a position, which is at a not-so-precise position with respect to a secondary transfer roller of secondary transfer unit, by which a relative positions of the secondary transfer roller and the decharging member and a relative position precision of the decharging member, which may affect separation performance, may be set with insufficient positional precision.

In the image forming apparatus 500 of the first example embodiment, the decharging member 401 is fixed to the transfer-position-exit-side guide unit 210, and the transfer-position-exit-side guide unit 210 is positioned with respect to the secondary transfer roller 21 and the fixing unit 30. Accordingly, the decharging needles 401*a* can be positioned with respect to the secondary transfer roller 21 and the fixing unit 30. Therefore, relative position precision of the leading edge of decharging needles 401*a* with respect to the secondary transfer roller 21 can be enhanced.

Further, by enhancing the relative position precision of the leading edge of decharging needles 401*a* with respect to the secondary transfer roller 21, relative position precision of the leading edge of decharging needles 401*a* with respect to the transfer sheet 25, which is transported, can be enhanced. As above described, the transfer sheet 25 passes the secondary transfer position set between the secondary transfer roller 21 and the intermediate transfer belt 10, and then the transfer sheet 25 is transported toward the fixing unit 30. With such a configuration, relative positions of the leading edge of decharging needles 401*a* and the transfer sheet 25 may not deviate from a preferable positional relationship, by which sheet jamming or image failure, caused by positional deviation of the decharging needles 401*a*, can be prevented.

Further, when a position of the secondary transfer roller 21 in the image forming apparatus 500 may deviate from a given reference position due to an effect of added tolerance or deformation of parts, the decharging needles 401*a* can follow such deviation of the secondary transfer roller 21, by which the relative positions of the secondary transfer roller 21 and the decharging needles 401*a* can be maintained at a preferable level.

To separate the transfer sheet 25 from the intermediate transfer belt 10, relative position precision and relative positional relationship of the decharging needles 401*a* and the secondary transfer roller 21 needs to be set to a given level. The above-described configuration can realize a preferable level of relative position precision and relative positional relationship of the decharging needles 401*a* and the secondary transfer roller 21.

In the first example embodiment, the transfer-position-exit-side guide unit 210 is used as a support member supporting the decharging member 401 having the decharging needles 401*a*. However, another decharging-needle support member can be provided instead of using the transfer-position-exit-side guide unit 210 as decharging-needle support member. Even if such decharging-needle support member is provided separately, the decharging-needle support member can be set to a given position with respect to the secondary transfer roller 21 and the fixing unit 30, by which relative position precision and relative positional relationship of the decharging needles 401*a* and the secondary transfer roller 21 can be maintained at a preferable level.

A description is now given to a second example embodiment according to the present invention with reference to FIG. 13 to FIG. 17. In the second example embodiment, the present invention is applied to a transportation route extending from the registration roller 28 to the fixing roller 301, for example, but not limited thereto.

Figure 13:
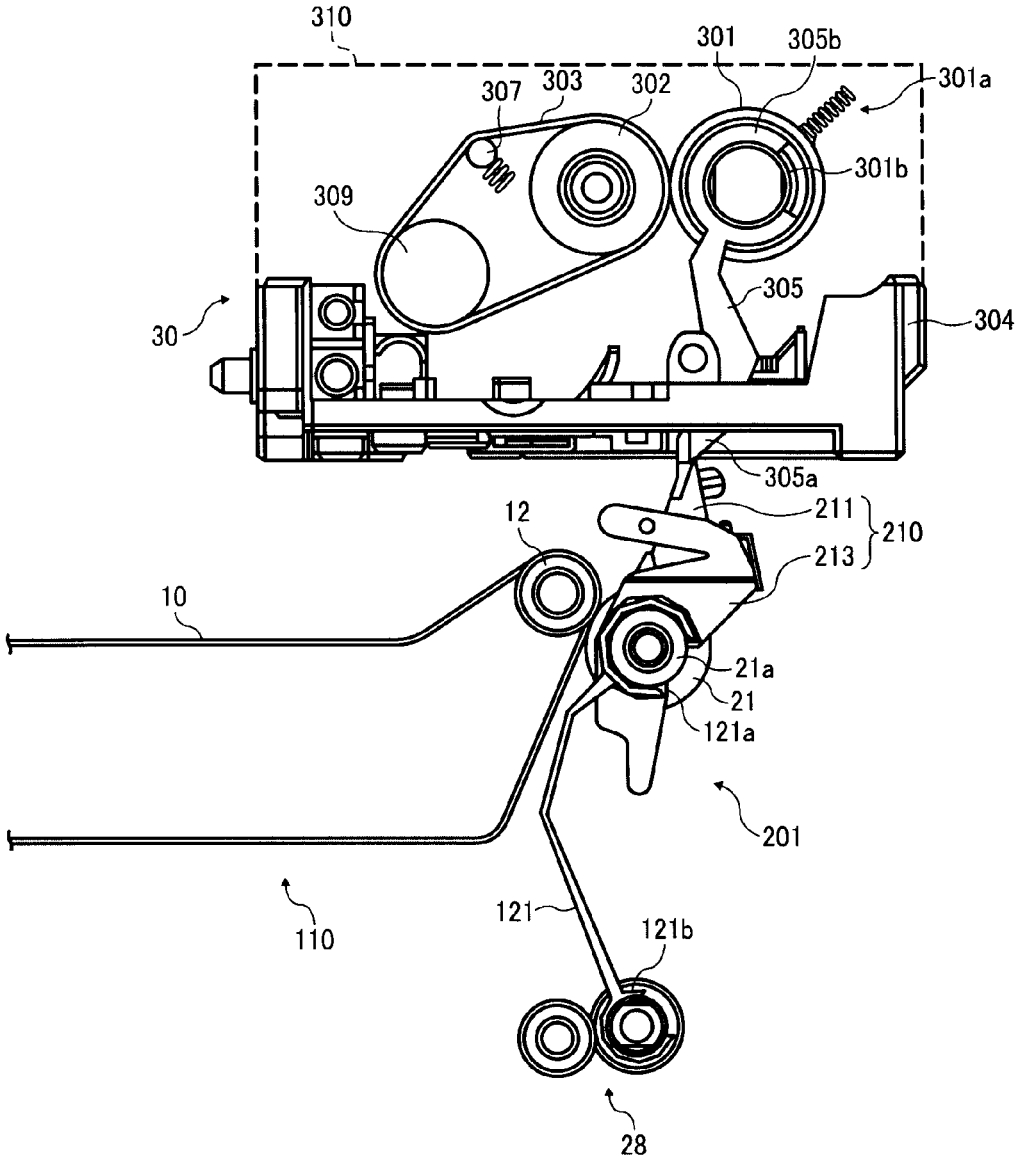
FIG. 13 illustrates a transportation route set between registration rollers and a fixing unit in an image forming apparatus according to a second example embodiment.

FIG. 13 illustrates a transportation route from the registration roller 28 to the fixing unit 30 in the image forming apparatus 500. In the second example embodiment, a configuration to position the fixing-position-entry-side guide member 305 at the upstream and downstream sides of sheet transport direction and a configuration to position the transfer-position-entry-side guide member 121 at the upstream and downstream sides of sheet transport direction is different from the first example embodiment. Common description for the first and second example embodiments is omitted in the following descriptions.

In FIG. 13, the transfer-position-exit-side guide unit 210 and the secondary transfer roller 21 are shown as components for the secondary transfer unit 201 because the secondary transfer unit 201 shown in FIG. 2 may be similarly used for the second example embodiment.

In FIG. 13, a upstream side of sheet transportation direction of the fixing-position-entry-side guide member 305 is positioned at a given position with respect to the secondary transfer unit 201, and a downstream side of sheet transportation direction of the fixing-position-entry-side guide member 305 is positioned at a given position with respect to the fixing roller 301.

Further, a upstream side of sheet transportation direction of the transfer-position-entry-side guide member 121 is positioned at a given position with respect to the registration roller 28, and a downstream side of sheet transportation direction of the transfer-position-entry-side guide member 121 is positioned at a given position with respect to the secondary transfer roller 21.

Figure 14:
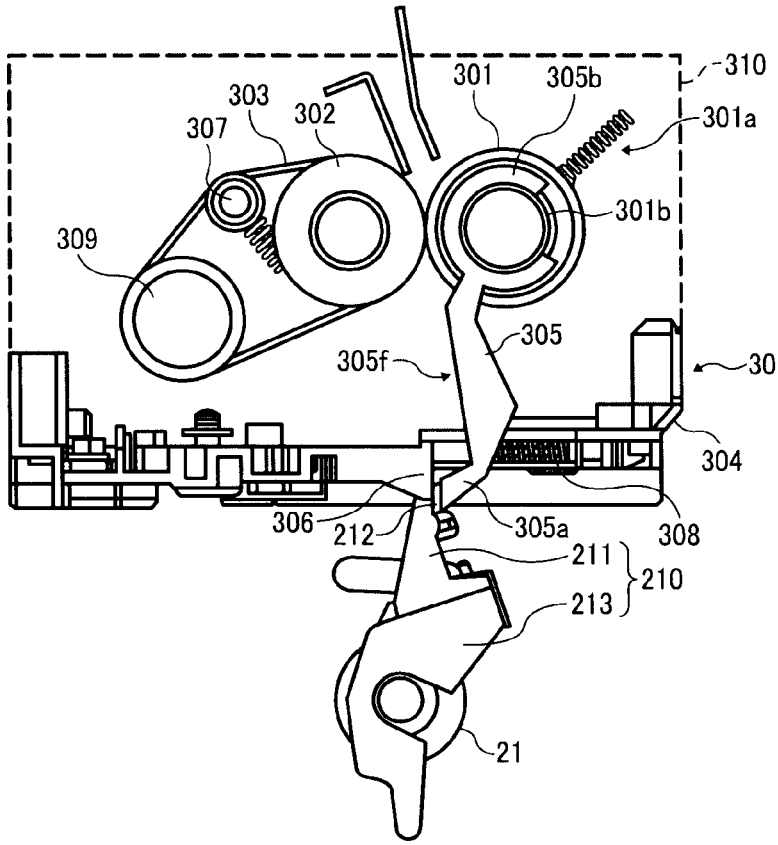
FIG. 14 illustrates the fixing unit and a secondary-transfer-position-exit-side guide member disposed under the fixing unit of FIG. 13.
Figure 15:
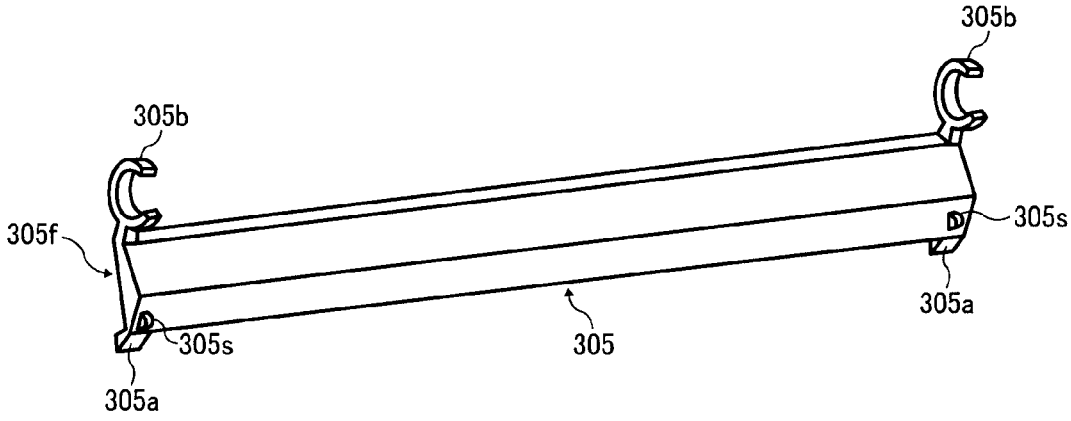
FIG. 15 illustrates a perspective view of a fixing-position-entry-side guide member for the second example embodiment.

A description is now given to a configuration of positioning of the fixing-position-entry-side guide member 305 with reference to FIGS. 14 and 15. FIG. 14 illustrates the fixing unit 30, and the transfer-position-exit-side guide unit 210, which is disposed under the fixing unit 30, and FIG. 15 illustrates a perspective view of the fixing-position-entry-side guide member 305.

As shown in FIGS. 14 and 15, the fixing-position-entry-side guide member 305 includes a fixing-entry-side guide contact portion 305*a*, and a fixing-entry-side guide engagement portion 305*b*. The fixing-entry-side guide contact portion 305*a* is used to position the fixing-position-entry-side guide member 305 at the upstream side of sheet transport direction. The fixing-entry-side guide engagement portion 305*b* is used to position the fixing-position-entry-side guide member 305 at the downstream side of sheet transport direction. Further, the fixing-position-entry-side guide member 305 is formed with a fixing-entry-side spring engagement hole 305*s* on a backside of the fixing-entry-side guide contact portion 305*a*. The fixing-entry-side spring engagement hole 305*s* is used to engage with a fixing-entry-side guide pressing spring 308 shown in FIG. 14.

As shown in FIG. 14, one end of the fixing-entry-side guide pressing spring 308 is fixed to the fixing-unit bottom plate 304 of the fixing unit 30, and other end of the fixing-entry-side guide pressing spring 308 is engaged to the fixing-entry-side spring engagement hole 305*s* of the fixing-position-entry-side guide member 305.

When the fixing-entry-side guide pressing spring 308 is engaged to the fixing-entry-side spring engagement hole 305*s*, a length of the fixing-entry-side guide pressing spring 308 is set shorter than a natural length of spring. In such configuration, restoring force of the fixing-entry-side guide pressing spring 308 is used to abut the fixing-entry-side guide contact portion 305*a* to the guide contact portion 212, by which the transfer-position-exit-side guide unit 210 can be biased to a given direction. With such a configuration, the upstream side of sheet transport direction of the fixing-position-entry-side guide member 305 can be positioned with respect to the transfer-position-exit-side guide unit 210.

Further, a fixing-roller ball bearing 301*b* is disposed at each end portion of a rotary shaft of the fixing roller 301. Accordingly, relative positional relationship of the fixing-roller ball bearing 301*b* with respect to the fixing roller 301 is fixed. By engaging (or fitting) the fixing-entry-side guide engagement portion 305*b* to the fixing-roller ball bearing 301*b*, the fixing-position-entry-side guide member 305 can be positioned with respect to the fixing roller 301 at the downstream side of sheet transport direction of the fixing-position-entry-side guide member 305.

As such, the upstream side of sheet transportation direction of the fixing-position-entry-side guide member 305 is positioned with respect to the transfer-position-exit-side guide unit 210 of the secondary transfer unit 201 including the secondary transfer roller 21, and the downstream side of sheet transportation direction of the fixing-position-entry-side guide member 305 is positioned with respect to the fixing roller 301.

Accordingly, even if relative position of the secondary transfer roller 21 and the fixing roller 301 may deviate from a preferable relative position, a relative position of the secondary transfer roller 21 with respect to the fixing-position-entry-side guide member 305, and a relative position of the fixing roller 301 with respect to the fixing-position-entry-side guide member 305 can be maintained at preferable relative position.

As such, as shown in FIG. 14, one side of sheet transport direction for the fixing-position-entry-side guide member 305 is positioned with respect to a bearing of the fixing roller 301, and other one side of sheet transport direction for the fixing-position-entry-side guide member 305 is positioned with respect to the secondary transfer unit 201 (used as secondary transfer unit) by abutting the fixing-position-entry-side guide member 305 to the transfer-position-exit-side guide unit 210 of the secondary transfer unit 201.

With such a configuration, relative position precision and relative positional relationship of guide member with respect to the fixing roller 301, and relative position precision and relative positional relationship of guide member with respect to the secondary transfer unit 210 can be enhanced compared to a conventional apparatus.

As above described, the fixing-roller ball bearing 301*b*, used as a of the fixing roller 301, is used as a component to set a reference position for positioning, wherein the fixing-roller ball bearing 301*b* may be manufactured with a higher precision because of its required functionality. Accordingly, by setting a relative position of the guide member 210 based on such component having higher precision, positioning precision can be enhanced.

With such a configuration, sheet transporting performance between the secondary transfer position and the fixing position can be enhanced. For example, wrinkles may not occur on the transfer sheet 25, and sheet jamming may not occur in a sheet transportation route between the secondary transfer position and the fixing position.

In the second example embodiment, a part of the fixing-position-entry-side guide member 305 is abutted to the guide contact portion 212 of the transfer-position-exit-side guide unit 210 (of the secondary transfer unit 201) to position the fixing-position-entry-side guide member 305 at a given position. However, the part of the fixing-position-entry-side guide member 305 can be abutted other portions. For example, the fixing-position-entry-side guide member 305 can be abutted any components configuring the secondary transfer unit 201 such as for example a shaft of the secondary transfer roller 21, the unit casing 205 used as a casing of the secondary transfer unit 201, and other portion of the transfer-position-exit-side guide unit 210.

Further, as similar to the first example embodiment, in the secondary transfer unit 201, among components of the secondary transfer unit 201, relative positional relationship of the transfer-position-exit-side guide unit 210 with respect to the secondary transfer roller 21 may be at least substantially fixed.

In such configuration, some components of the secondary transfer unit 201 and a support structure for the secondary transfer roller 21 may have smaller strength, and relative position of such components with respect to the secondary transfer roller 21 may change for some level. Then, a part of the fixing-position-entry-side guide member 305 may be abutted to such components. Even in such abutting configuration, a relative position of such components with respect to the fixing-position-entry-side guide member 305 can be maintained at a given level. Accordingly, sheet transporting performance from the secondary transfer position to the fixing position can be enhanced compared to a configuration that the fixing-position-entry-side guide member 305 is not properly positioned with respect to the secondary transfer unit 201.

Figure 16:
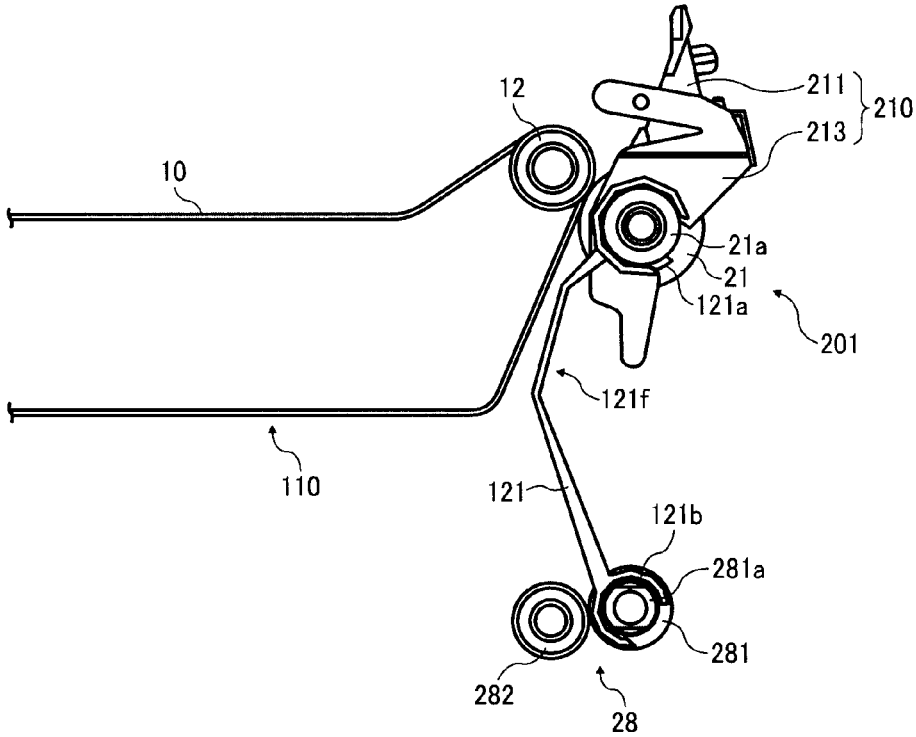
FIG. 16 illustrates members for setting a secondary transfer position and registration rollers disposed under the secondary transfer position for the second example embodiment.
Figure 17:
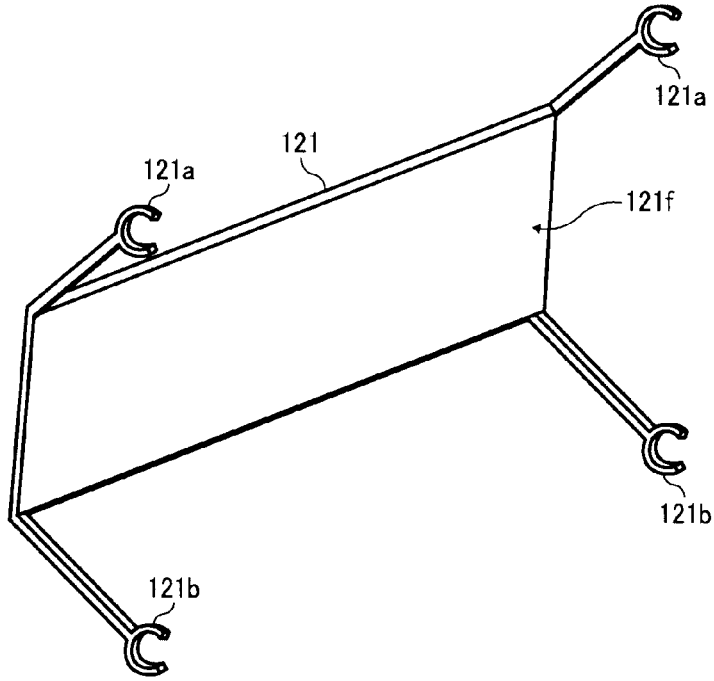
FIG. 17 illustrates a perspective view of a secondary-transfer-position-entry-side guide member for the second example embodiment.

A description is now given to a configuration for positioning the transfer-position-entry-side guide member 121 according to the second example embodiment with reference to FIGS. 16 and 17. FIG. 16 illustrates the secondary transfer position, set by the intermediate transfer unit 110 and the secondary transfer unit 201 having the secondary transfer roller 21, and the registration roller 28 disposed under the secondary transfer position, and FIG. 17 illustrates a perspective view of the transfer-position-entry-side guide member 121. As shown in FIGS. 16 and 17, the transfer-position-entry-side guide member 121 includes a transfer-position-downstream-side guide engagement portion 121*a* and a transfer-position-upstream-side guide engagement portion 121*b*. The transfer-position-upstream-side guide engagement portion 121*b* is used to position the transfer-position-entry-side guide member 121 at a given position of the upstream side of sheet transport direction for the transfer-position-entry-side guide member 121. The transfer-position-downstream-side guide engagement portion 121*a* is used to position the transfer-position-entry-side guide member 121 at a given position of the downstream side of sheet transport direction for the transfer-position-entry-side guide member 121.

As shown in FIG. 16, at the downstream side of sheet transport direction of the transfer-position-entry-side guide member 121, the transfer-position-downstream-side guide engagement portion 121*a* is fitted to the transfer-shaft ball bearing 21*a* to position the transfer-position-entry-side guide member 121 with respect to the secondary transfer roller 21, wherein the relative position of the transfer-shaft ball bearing 21*a* with respect to the secondary transfer roller 21 is substantially fixed.

Further, the registration roller 28 includes a pair of rollers such as a registration drive roller 282 and a registration driven roller 281. The registration driven roller 281 is disposed with a registration-roller ball bearing 281*a* at both end of a rotary shaft of registration driven roller 281.

At the upstream side of sheet transport direction of the transfer-position-entry-side guide member 121, the transfer-position-upstream-side guide engagement portion 121*b* is fitted to the registration-roller ball bearing 281*a* to position the transfer-position-entry-side guide member 121 with respect to the registration driven roller 281, wherein the relative position of the registration-roller ball bearing 281*a* with respect to the registration driven roller 281 is substantially fixed.

As such, the upstream side of sheet transport direction of the transfer-position-entry-side guide member 121 is positioned with respect to the registration roller 28, and the downstream side of sheet transport direction of the transfer-position-entry-side guide member 121 is positioned with respect to the secondary transfer roller 21.

Accordingly, even if the relative position of the registration roller 28 and the secondary transfer roller 21 may deviate from a preferable relative position, a relative position of the registration roller 28 with respect to the transfer-position-entry-side guide member 121, and a relative position of the secondary transfer roller 21 with respect to the transfer-position-entry-side guide member 121 can be maintained at preferable relative position.

As such, as shown in FIG. 16, one side of sheet transport direction for the transfer-position-entry-side guide member 121 is positioned with respect to a bearing of the registration roller 28, and other one side of sheet transport direction for the transfer-position-entry-side guide member 121 is positioned with respect to a bearing of the secondary transfer roller 21.

In conventional configuration, the transfer-position-entry-side guide member 121 may be positioned with respect to the intermediate transfer unit 110. However, a relative position and relative position precision of the intermediate transfer unit 110 and the registration roller 28 may fluctuate when tolerance of each part is added. Further, a relative position of the intermediate transfer unit 110 and the registration roller 28 may be deviated from a given position such as twisted position.

In contrast, in the second example embodiment, even if the registration roller 28 may deviate from a preferable position for some level, the transfer-position-entry-side guide member 121 can follow such positional deviation, and thereby the relative position of the guide member can be maintained at a preferable level.

Accordingly, compared to conventional apparatuses, relative position precision and relative positional relationship of the transfer-position-entry-side guide member 121 with respect to the registration roller 28 and relative position precision and relative positional relationship of the transfer-position-entry-side guide member 121 with respect to the secondary transfer roller 21 can be enhanced.

Such enhancement of positioning precision can be realized because the bearing of the registration roller 28 is used as a component to set a reference position for positioning, and the transfer-position-entry-side guide member 121 is position with respect such component.

With such a configuration, sheet transporting performance from the registration roller 28 to the secondary transfer position can be enhanced, and sheet jamming may not occur in a transport route from the registration roller 28 to the secondary transfer position, and image failure during the secondary transfer process such as image is not produced in parallel on the transfer sheet 25 can be reduced.

Further, as shown in FIG. 13, a guide member can be positioned between a upstream-side unit and downstream-side unit disposed in the image forming apparatus 500, wherein such guide member may be the transfer-position-entry-side guide member 121, the transfer-position-exit-side guide unit 210, and the fixing-position-entry-side guide member 305. For example, the transfer-position-entry-side guide member 121 is positioned by the registration roller 28 (or registration unit) and the secondary transfer roller 21 of the secondary transfer unit 201; the transfer-position-exit-side guide unit 210 is positioned by the secondary transfer roller 21 and the fixing unit 30; and the fixing-position-entry-side guide member 305 is positioned by the transfer-position-exit-side guide unit 210 and the fixing roller 301.

With such configurations, guide members disposed between two transportation members (may be referred to as surface moving member) disposed along the transportation route for the transfer sheet can be set to a given position in the second example embodiment. Such configuration can enhance relative position precision of guide members because adding effect of tolerance can be reduced compared to conventional positioning method Further, when relative position of the surface moving members, which transport the transfer sheet 25 from one surface moving member to another surface moving member, is deviated from a preferable position, the guide member can follow such deviation, by which relative position of guide member and the surface moving members can be maintained at a preferable level.

Sheet transporting performance in the transportation route, extending from a registration unit, the secondary transfer position, and to the fixing position, may affect image quality (or image failure). For example, if the sheet transporting performance is not so good, image may not be accurately produced on a sheet during a secondary transfer process (e.g., image may be produced un-paralleled manner), or wrinkles may occur on sheets during a fixing process. Such sheet transporting performance may become further important for image forming apparatuses, which transport sheets in a substantially vertical direction (referred to as vertical-type image forming apparatus).

In the second example embodiment, a relative position of surface moving members (e.g., transportation member), which transport the transfer sheet 25 from one surface moving member to another surface moving member, may be deviated from a preferable position in the transportation route extending from the registration unit to the fixing position of the image forming apparatus 500. Because a guide member can follow such deviation, a relative position of the guide member and the surface moving members can be maintained at a preferable level. Accordingly, sheet transporting performance in the transportation route extending from the registration unit to the fixing position can be enhanced, and thereby problems of image forming can be reduced. Such problems may be that image is not accurately produced on a sheet during a secondary transfer process (e.g., image may be produced un-paralleled manner), and occurrence of wrinkles on sheets during a fixing process.

The upstream-side unit and downstream-side unit for each of guide members are listed as below, but not limited these.

A) upstream-side unit for transfer-position entry-side guide member: registration unit;

B) downstream-side unit for transfer-position entry-side guide member: secondary transfer unit, intermediate transfer unit, fixing unit;

C) upstream-side unit for transfer-position exit-side guide member: secondary transfer unit, intermediate transfer unit, registration unit;

D) downstream-side unit for transfer-position exit-side guide member: fixing unit;

E) upstream-side unit for fixing-position entry-side guide member: registration unit, intermediate transfer unit, secondary transfer unit;

F) downstream-side unit for fixing-position entry-side guide member: fixing unit.

In the first example embodiment, the transfer-position-exit-side guide unit 210 is positioned with respect to the secondary transfer roller 21 and the fixing unit 30. However, the upstream side of sheet transport direction of the transfer-position-exit-side guide unit 210 can be positioned using a member included in the intermediate transfer unit 110, for example.

Figure 18:
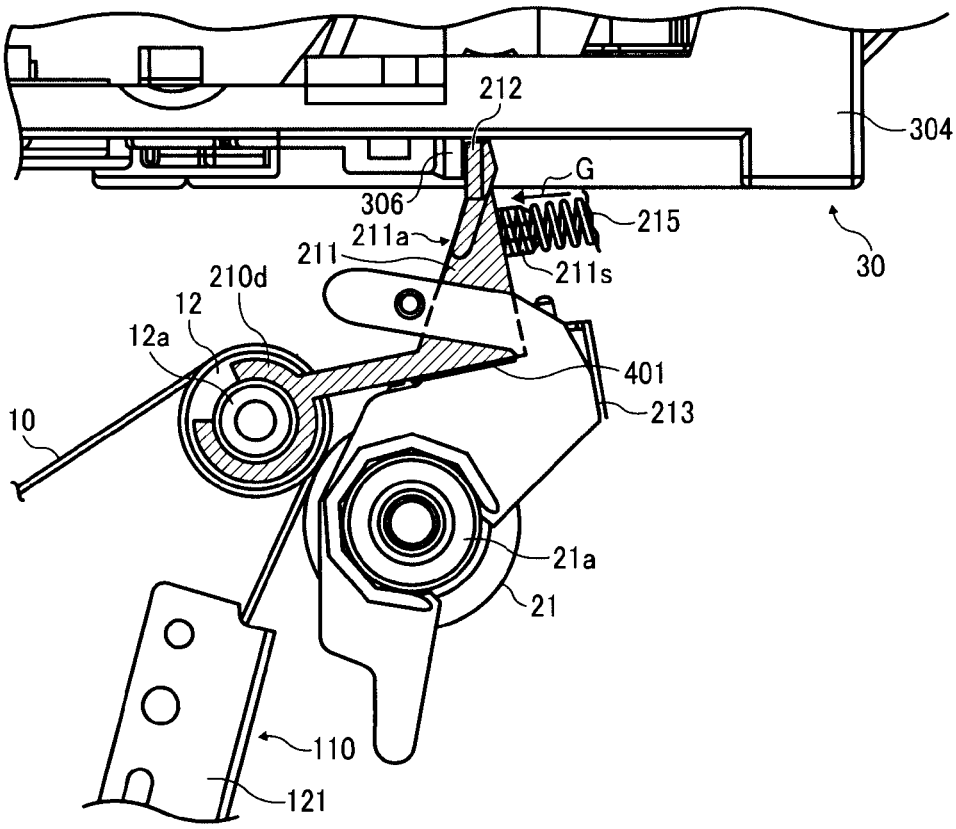
FIG. 18 illustrates a configuration of positioning a secondary-transfer-position-exit-side guide member of modified example 1.

A description is now given to a modified example 1 with reference to FIG. 18, in which the upstream side of sheet transport direction of the transfer-position-exit-side guide unit 210 is positioned using the secondary-transfer counter roller 12, which is one member configuring the intermediate transfer unit 110. FIG. 18 illustrates a configuration for positioning the transfer-position-exit-side guide unit 210.

In the first example embodiment, the transfer-position-exit-side guide member 211 is fixed to the transfer-roller engaging member 213 to configure the transfer-position-exit-side guide unit 210.

On one hand, in the modified example 1, the transfer-position-exit-side guide unit 210 includes the transfer-position-exit-side guide member 211 having a transfer-counter-roller engaging member 210*d*, which is indicated by slashed lines in FIG. 18. Further, as shown in FIG. 18, the secondary-transfer counter roller 12 is disposed with a transfer-counter-roller ball bearing 12*a* at both end of shaft of the secondary-transfer counter roller 12, and the transfer-counter-roller engaging member 210*d* engages the transfer-counter-roller ball bearing 12*a*.

As shown in FIG. 18, at the downstream side of sheet transport direction of the transfer-position-exit-side guide unit 210, the guide contact portion 212 of the transfer-position-exit-side guide member 211 is abutted to the abutting portion 306 of the fixing-unit bottom plate 304 of the fixing unit 30 to position the transfer-position-exit-side guide unit 210 with respect to the fixing unit 30.

Further, at the upstream side of sheet transport direction of the transfer-position-exit-side guide unit 210, the transfer-counter-roller engaging member 210*d* is engaged to the transfer-counter-roller ball bearing 12*a* to position the transfer-position-exit-side guide unit 210 with respect to the secondary-transfer counter roller 12, wherein a relative position of the transfer-counter-roller ball bearing 12*a* with respect to the secondary-transfer counter roller 12 is substantially fixed.

As such, the transfer-position-exit-side guide unit 210 is positioned with respect to the secondary-transfer counter roller 12, which is at the upstream side of sheet transport direction of the transfer-position-exit-side guide unit 210, and the transfer-position-exit-side guide unit 210 is positioned with respect to the fixing unit 30, which is at the downstream side of sheet transport direction.

With such a configuration, even if relative position of the secondary-transfer counter roller 12 and the fixing roller 301 may deviate from a preferable position, relative position of the transfer-position-exit-side guide member 211 with respect to the secondary-transfer counter roller 12 and the fixing roller 301 can be maintained at a preferable level.

Accordingly, as similar to the first example embodiment, sheet transporting performance from the secondary transfer position to the fixing position can be enhanced, and sheet jamming may not occur in the transportation route from the secondary transfer position to the fixing position, and occurrence of wrinkles on the transfer sheet 25 in the transportation route from the secondary transfer position to the fixing position can be suppressed.

In the modified example 1, a part of the transfer-position-exit-side guide unit 210 is engaged to the transfer-counter-roller ball bearing 12*a* of the secondary-transfer counter roller 12 to position the transfer-position-exit-side guide unit 210. However, the part of the transfer-position-exit-side guide unit 210 can be engaged to other portion of the intermediate transfer unit 110. For example, a part of the transfer-position-exit-side guide unit 210 can be abutted to the front frame 111 or rear frame 112, which is used a part of a casing of the intermediate transfer unit 110, and other part of the intermediate transfer unit 110 (intermediate transfer unit). As such, the transfer-position-exit-side guide unit 210 can be positioned with respect to the intermediate transfer unit 110 by abutting the part of the transfer-position-exit-side guide unit 210 to the intermediate transfer unit 110.

As such, the upstream side of the transfer-position-exit-side guide unit 210 can be positioned with respect to a member of the intermediate transfer unit 110, and the downstream side of the transfer-position-exit-side guide unit 210 can be positioned with respect to a member of the fixing unit 30, by which sheet transporting performance from the secondary transfer position to the fixing position can be enhanced.

In the second example embodiment, the transfer-position-entry-side guide member 121 is positioned with respect to the secondary transfer roller 21 and the registration roller 28. However, the downstream side of sheet transport direction of the transfer-position-entry-side guide member 121 can be positioned using a member included in the intermediate transfer unit 110, for example.

Figure 19:
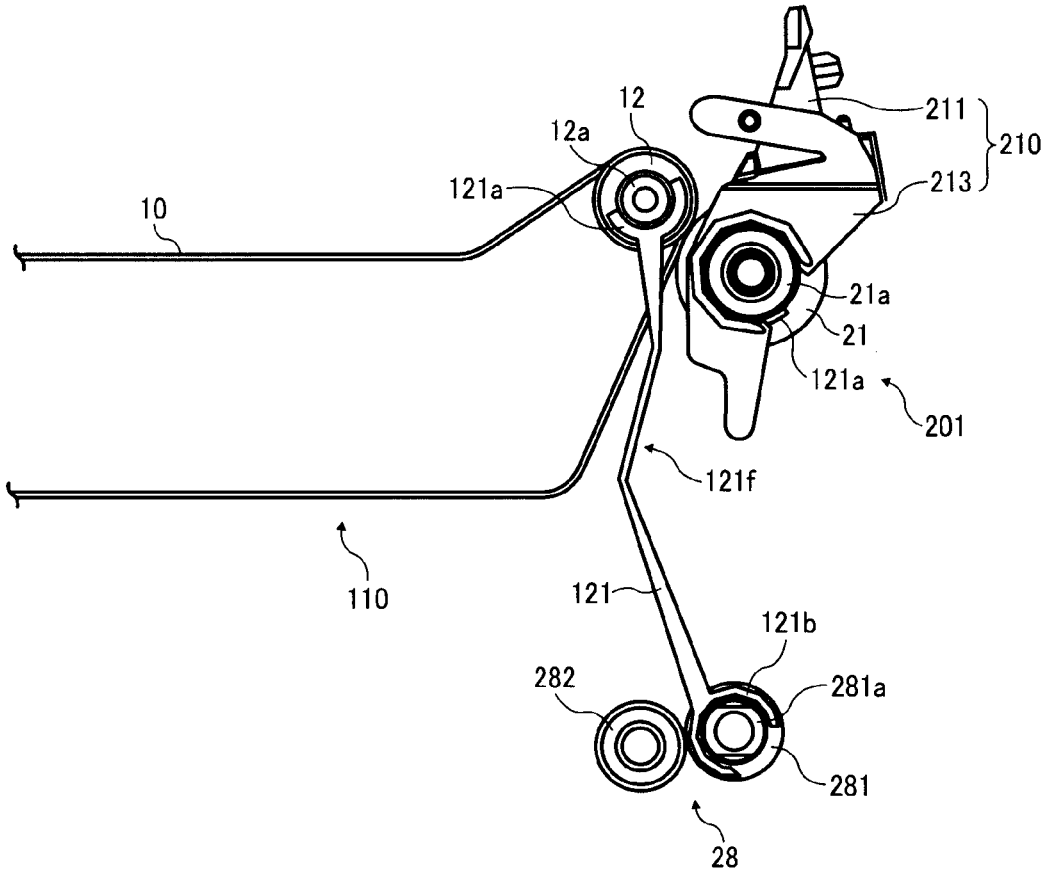
FIG. 19 illustrates a configuration of positioning a secondary-transfer-position-entry side guide member of modified example 2.

A description is now given to a modified example 2, in which the downstream side of sheet transport direction of transfer-position-entry-side guide member 121 is positioned using the secondary-transfer counter roller 12, which is one member configuring the intermediate transfer unit 110 with reference to FIG. 19. FIG. 19 illustrates a configuration for positioning the transfer-position-entry-side guide member 121.

In the second example embodiment, the transfer-position-downstream-side guide engagement portion 121*a* of the transfer-position-entry-side guide member 121 is engaged (or fitted) to the transfer-shaft ball bearing 21*a* to position the transfer-position-entry-side guide member 121 with respect to the secondary transfer roller 21.

On one hand, in the modified example 2, as shown in FIG. 19, the secondary-transfer counter roller 12 is disposed with the transfer-counter-roller ball bearing 12*a* at both end of shaft of the secondary-transfer counter roller 12. The transfer-position-entry-side guide member 121 is positioned with respect to the secondary-transfer counter roller 12 by engaging the transfer-position-downstream-side guide engagement portion 121*a* to the transfer-counter-roller ball bearing 12*a*.

Further, the registration roller 28 includes a pair of rollers such as a registration drive roller 282 and a registration driven roller 281. The registration driven roller 281 is disposed with a registration-roller ball bearing 281*a* at both end of a rotary shaft of registration driven roller 281.

At the upstream side of sheet transport direction of the transfer-position-entry-side guide member 121, the transfer-position-upstream-side guide engagement portion 121*b* is engaged (or fitted) to the registration-roller ball bearing 281*a* to position the transfer-position-entry-side guide member 121 with respect to the registration driven roller 281, wherein the relative position of the registration-roller ball bearing 281*a* with respect to the registration driven roller 281 is substantially fixed.

As such, the upstream side of sheet transport direction of the transfer-position-entry-side guide member 121 is positioned with respect to the registration roller 28, and the downstream side of sheet transport direction of the transfer-position-entry-side guide member 121 is positioned with respect to the secondary-transfer counter roller 12.

Accordingly, even if the relative position of the registration roller 28 and the secondary-transfer counter roller 12 may deviate from a preferable position, relative position of the registration roller 28 with respect to the transfer-position-entry-side guide member 121, and relative position of the transfer-position-entry-side guide member 121 with respect to the secondary-transfer counter roller 12 can be maintained at preferable level.

With such a configuration, sheet transporting performance from the registration roller 28 to the secondary transfer position can be enhanced, and sheet jamming may not occur in a transport route from the registration roller 28 to the secondary transfer position, and image failure during the secondary transfer process such as image data is not produced in parallel on the transfer sheet 25 can be reduced.

In the modified example 2, a part of the transfer-position-entry-side guide member 121 is engaged to the transfer-counter-roller ball bearing 12*a* of the secondary-transfer counter roller 12 to position the transfer-position-entry-side guide member 121. However, a part of the transfer-position-entry-side guide member 121 can be engaged to other portion of the intermediate transfer unit 110. For example, a part of the transfer-position-entry-side guide member 121 can be abutted to the front frame 111 or rear frame 112, which is used a part of a casing of the intermediate transfer unit 110, and other part of the intermediate transfer unit 110 (intermediate transfer unit). The transfer-position-entry-side guide member 121 can be positioned with respect to the intermediate transfer unit 110 by abutting the part of the transfer-position-entry-side guide member 121 to the intermediate transfer unit 110.

As such, the upstream side of the transfer-position-entry-side guide member 121 can be positioned with respect to a member of the registration unit, and the downstream side of the transfer-position-entry-side guide member 121 can be positioned with respect to a member of the intermediate transfer unit 110, by which sheet transporting performance from the registration roller to the secondary transfer position can be enhanced.

In the above described example embodiments, the image forming apparatus 500 may include the intermediate transfer belt 10 as a toner image carrying member, which endlessly moves while carrying a toner image. Further, the image forming apparatus 500 may include the secondary transfer roller 21, and the fixing unit 30.

The secondary transfer roller 21 transfers the toner image from the intermediate transfer belt 10 to the transfer sheet 25 (used as recording medium) at the secondary transfer position, wherein the toner image is transferred to a recording medium at the secondary transfer position. The secondary transfer roller 21 is used as image transfer device, which transfers the toner image to the recording medium.

The fixing unit 30 fixes toner image on the transfer sheet 25, which is transferred by the secondary transfer roller 21, at the fixing position. As such, the fixing unit 30 is used as fixing device or means for fixing.

Further, the image forming apparatus 500 may include the registration unit. The registration unit is disposed at the upstream side of sheet transport direction of the transfer sheet 25 with respect to the secondary transfer position, and includes the registration roller 28 to transport the transfer sheet 25 to the secondary transfer position at a given timing.

In the first example embodiment, the image forming apparatus 500 may include the transfer-position-exit-side guide unit 210. The transfer-position-exit-side guide unit 210 guides a movement of the transfer sheet 25 when the transfer sheet 25 moves along the transfer-position-exit-side guide unit 210.

Further, the image forming apparatus 500 may include the secondary transfer roller 21, and the fixing roller 301. The secondary transfer roller 21 and the fixing roller 301 are disposed respectively at the upstream side and downstream side of sheet transport direction with respect to the transfer-position-exit-side guide unit 210, and to move the transfer sheet 25 when the secondary transfer roller 21 and the fixing roller 301 rotates. The secondary transfer roller 21 is used as an upstream-side transportation member, and the fixing roller 301 is used as a downstream-side transportation member.

Further, in the image forming apparatus 500 of the first example embodiment, the relative position of the secondary transfer roller 21 and the fixing roller 301 may fluctuate among finished apparatuses due to variation of tolerance, which may occur during the manufacturing process and deformation of assembled parts.

The image forming apparatus 500 of the first example embodiment may include the secondary transfer unit 201 used as a upstream-side transportation unit, wherein the secondary transfer unit 201 includes the secondary transfer roller 21 having the transfer-shaft ball bearing 21*a*. The transfer-shaft ball bearing 21*a* is used to set a relative position of the secondary transfer roller 21 or the transfer-position-exit-side guide unit 210. As such, the transfer-shaft ball bearing 21*a* is used as a upstream-side positioning member to position the transfer-position-exit-side guide unit 210 at a given position.

As such, the transfer-position-exit-side guide unit 210 is positioned with respect to the transfer-shaft ball bearing 21*a*, wherein a relative position of the transfer-shaft ball bearing 21*a* with respect to the secondary transfer roller 21 is substantially fixed even if the above-mentioned instability occurs to components configuring the secondary transfer unit 201.

Further, the fixing unit 30 including the fixing roller 301 used as a downstream-side transportation unit. The fixing unit 30 may include the fixing-unit bottom plate 304 to set a relative position of the fixing roller 301 and the transfer-position-exit-side guide unit 210. The fixing-unit bottom plate 304 is used as a downstream-side positioning member. As such, the transfer-position-exit-side guide unit 210 is positioned with respect to the fixing-unit bottom plate 304, wherein a relative position of the fixing-unit bottom plate 304 with respect to the fixing roller 301 is substantially fixed even if the above-mentioned instability occurs to components configuring the fixing unit 30.

In the image forming apparatus 500 of the first example embodiment, the transfer-position-exit-side guide unit 210 is positioned with respect to the transfer-shaft ball bearing 21*a* of the secondary transfer unit 201, wherein the relative position of the transfer-shaft ball bearing 21*a* with respect to the secondary transfer roller 21 is substantially fixed. Accordingly, the transfer-position-exit-side guide unit 210 can be positioned (and fixed) with respect to the secondary transfer roller 21. Accordingly, sheet transporting performance of the transfer sheet 25 from the secondary transfer roller 21 to the transfer-position-exit-side guide unit 210 can be maintained at a preferable level.

Further, the transfer-position-exit-side guide unit 210 is positioned with respect to the fixing-unit bottom plate 304 of the fixing unit 30, wherein the relative position of the fixing-unit bottom plate 304 with respect to the fixing unit 30 is substantially fixed. Accordingly, the transfer-position-exit-side guide unit 210 can be positioned (and fixed) with respect to the fixing roller 301. Accordingly, sheet transporting performance of the transfer sheet 25 from the transfer-position-exit-side guide unit 210 to the fixing roller 301 can be maintained at a preferable level.

As such, in the image forming apparatus 500 of the first example embodiment, sheet transporting performance from the secondary transfer roller 21 to the transfer-position-exit-side guide unit 210, and sheet transporting performance from the transfer-position-exit-side guide unit 210 to the fixing roller 301 can be secured at a good level, by which sheet transporting performance between the secondary transfer roller 21 and the fixing roller 301 can be secured at a good level, wherein the secondary transfer roller 21 and the fixing roller 301 are adjacent transportation members used to transport the transfer sheet 25.

Further, in the first and second example embodiments, the image forming apparatus 500 includes the secondary transfer unit 201 as an image transfer device to transfer an image to a recording medium. The secondary transfer unit 201 includes the secondary transfer roller 21, used as a transfer roller. The secondary transfer roller 21 faces the intermediate transfer belt 10 at the secondary transfer position; the secondary transfer roller 21 sandwiches the transfer sheet 25 with the intermediate transfer belt 10; the secondary transfer roller 21 applies transportation force to the transfer sheet 25 by rotating the roller, and transfers toner image from the intermediate transfer belt 10 to the transfer sheet 25. The secondary transfer roller 21 may be used one of upstream-side transportation member and downstream-side transportation member.

Further, the transfer-position-exit-side guide unit 210 is disposed at the downstream side of sheet transport direction with respect to the secondary transfer position, and the transfer-position-entry-side guide member 121 is disposed at the upstream side of sheet transport direction with respect to the secondary transfer position. Such guide members are positioned with respect to the transfer-shaft ball bearing 21*a* of the secondary transfer roller 21. The relative position of the transfer-shaft ball bearing 21*a* with respect to the secondary transfer roller 21 is substantially fixed even if the above-mentioned instability occurs to components configuring the secondary transfer unit 201. Accordingly, such guide members can be positioned with respect to the rotary shaft of the secondary transfer roller 21.

With such a configuration, the relative position precision between the secondary transfer roller 21 and the transfer-position-exit-side guide unit 210, or the relative position precision between the secondary transfer roller 21 and the transfer-position-entry-side guide member 121 can be enhanced. Accordingly, sheet transporting performance of the transfer sheet 25 from the secondary transfer position to the transfer-position-exit-side guide unit 210, or sheet transporting performance of the transfer sheet 25 from the transfer-position-entry-side guide member 121 to the secondary transfer position can be enhanced. Accordingly, sheet jamming near the secondary transfer position can be reduced.

Further, in the first example embodiment, the image forming apparatus 500 uses the fixing unit 30 as a fixing device or means for fixing. The fixing unit 30 includes the fixing roller 301 and the fixing belt 303 as fixing members (two surface moving members), which faces each other at the fixing position. The fixing roller 301 and the fixing belt 303 sandwich the transfer sheet 25 therebetween. The fixing roller 301 and the fixing belt 303 move the transfer sheet 25 with an effect of surface moving of rollers, and fix toner image on the transfer sheet 25. In such configuration, the secondary transfer roller 21 may be used as upstream-side transportation member, and the fixing roller 301 may be used as a downstream-side transportation member.

The transfer-position-exit-side guide unit 210 disposed at the downstream side of sheet transport direction with respect to the secondary transfer position is positioned with respect to the fixing-unit bottom plate 304 and the transfer-counter-roller ball bearing 12*a*. The relative position of the fixing-unit bottom plate 304 with respect to the fixing roller 301 is substantially fixed even if the above-mentioned instability may occur to components configuring the fixing unit 30, and the relative position of the transfer-counter-roller ball bearing 12*a* with respect to the secondary transfer unit 201 is also substantially fixed.

With such a configuration, the transfer-position-exit-side guide unit 210 can be positioned with respect to the fixing-unit bottom plate 304, and thereby the transfer-position-exit-side guide unit 210 can be positioned with respect to the fixing roller 301 (fixing member); and the transfer-position-exit-side guide unit 210 can be positioned with respect to the transfer-shaft ball bearing 21*a*, and thereby the transfer-position-exit-side guide unit 210 can be positioned with respect to the rotary shaft of the secondary transfer roller 21.

With such a configuration, the relative position precision between the transfer-position-exit-side guide unit 210 and the fixing unit 30, and the relative position precision between the transfer-position-exit-side guide unit 210 and the secondary transfer roller 21 can be enhanced, by which sheet transporting performance can be enhanced.

Further, even if the relative position of the secondary transfer roller 21 or the fixing unit 30 may deviate from a preferable position in the image forming apparatus 500, the transfer-position-exit-side guide unit 210 can follow such deviation of the secondary transfer roller 21 or the fixing unit 30, by which the relative position of the transfer-position-exit-side guide unit 210 with respect to the secondary transfer roller 21 and the fixing unit 30 can be maintained at a preferable level, by which sheet transporting performance can be maintained at a preferable level. By enhancing sheet transporting performance at the exit side of the secondary transfer position, occurrence of wrinkles on sheet during the fixing process can be reduced.

Further, the image forming apparatus 500 includes registration unit having the registration roller 28 composed of two rollers facing each other. The transfer sheet 25 is sandwiched between the two rollers, and by rotating one of two rollers (i.e., registration drive roller 282) at a given timing, the transfer sheet 25 is applied with transportation force.

In the second example embodiment, the image forming apparatus 500 uses the secondary transfer roller 21 as a downstream-side transportation member, and the registration roller 28 as an upstream-side transportation member.

The transfer-position-entry-side guide member 121 is disposed at the upstream side of sheet transport direction of the transfer sheet 25 with respect to the secondary transfer position. The upstream side of the transfer-position-entry-side guide member 121 is positioned with respect to the registration-roller ball bearing 281*a* of the registration driven roller 281, wherein the relative position of the registration-roller ball bearing 281*a* with respect to the registration roller 28 is substantially fixed even if positional instability may occur to components configuring the registration unit. Further, the downstream side of transfer-position-entry-side guide member 121 is positioned with respect to the transfer-shaft ball bearing 21*a* of the secondary transfer unit 201. As such, the transfer-position-entry-side guide member 121 can be positioned with respect to the registration-roller ball bearing 281*a*, and thereby the transfer-position-entry-side guide member 121 can be positioned with respect to the registration roller 28. Further, the transfer-position-entry-side guide member 121 can be positioned with respect to the transfer-shaft ball bearing 21*a*, and thereby the transfer-position-entry-side guide member 121 can be positioned with respect to the rotary shaft of the secondary transfer roller 21.

In such second example embodiment, in the image forming apparatus 500, adding effect of tolerance of parts can be reduced for the secondary transfer roller 21 and the registration roller 28 compared to a method positioning the transfer-position-entry-side guide member 121 using the apparatus housing 200 of the image forming apparatus 500 and a casing of the secondary transfer unit 201.

Accordingly, relative position precision of the transfer-position-entry-side guide member 121 with respect to the secondary transfer roller 21 and the registration roller 28 can be enhanced, by which sheet transporting performance can be enhanced.

Further, even if relative position of the secondary transfer roller 21 and the registration roller 28 may deviate from a preferable position in the image forming apparatus 500, the transfer-position-entry-side guide member 121 can follow such deviation, by which relative position of the transfer-position-entry-side guide member 121 with respect to the secondary transfer roller 21 and the registration roller 28 can be maintained at a preferable level, and thereby sheet transporting performance can be maintained at a preferable level. As such, by enhancing sheet transporting performance at the entry side of the secondary transfer position, image failure during the secondary transfer process, such as image is not produced in parallel on the transfer sheet 25, can be reduced.

Further, in the modified examples 1 and 2, the image forming apparatus 500 includes the secondary transfer unit 201 used as image transfer device. The secondary transfer unit 201 includes the secondary transfer roller 21 to transfer an toner image to a recording medium. The secondary transfer roller 21 faces the intermediate transfer belt 10 at the secondary transfer position; the secondary transfer roller 21 sandwiches the transfer sheet 25 with the intermediate transfer belt 10; and secondary transfer roller 21 rotates to move the transfer sheet 25, and transfers toner image from the intermediate transfer belt 10 to the transfer sheet 25. The intermediate transfer belt 10 may be used as one of upstream-side transportation member and downstream-side transportation member. Further, a guide member may be disposed at the downstream side or upstream side of sheet transport direction of the transfer sheet 25 with respect to the secondary transfer position. Such guide member may be positioned at a member configured with the intermediate transfer belt 10, wherein such member supports the intermediate transfer belt 10 and faces the secondary transfer roller 21. The intermediate transfer unit 110 includes the intermediate transfer belt 10 (as toner image carrying member).

For example, such guide member is positioned with respect to the transfer-counter-roller ball bearing 12*a* of the secondary-transfer counter roller 12, wherein the relative position of secondary-transfer counter roller 12 with respect to the intermediate transfer belt 10 is substantially fixed even if the above-mentioned instability may occur to components.

With such a configuration, the relative position precision between the intermediate transfer belt 10 and the transfer-position-exit-side guide unit 210 or the transfer-position-entry-side guide member 121 can be enhanced. Accordingly, sheet transporting performance of the transfer sheet 25 from the secondary transfer position to the transfer-position-exit-side guide unit 210, or sheet transporting performance of the transfer sheet 25 from the transfer-position-entry-side guide member 121 to the secondary transfer position can be enhanced. With such configuration, sheet jamming near the secondary transfer position can be reduced.

In the modified example 1, the image forming apparatus 500 uses the fixing unit 30 as a fixing device or means for fixing. The fixing unit 30 includes the fixing roller 301 and the fixing belt 303 as fixing members (two surface moving members), which faces each other at the fixing position. The fixing roller 301 and the fixing belt 303 sandwich the transfer sheet 25 therebetween. The fixing roller 301 and the fixing belt 303 move the transfer sheet 25 with an effect of surface moving of rollers, and fix toner image on the transfer sheet 25. In such configuration, the intermediate transfer belt 10 may be used as an upstream-side transportation member, and the fixing roller 301 is used as a downstream-side transportation member.

The transfer-position-exit-side guide unit 210 disposed at the downstream side of sheet transport direction of the transfer sheet 25 with respect to the secondary transfer position. The downstream side of the transfer-position-exit-side guide unit 210 is positioned with respect to the fixing-unit bottom plate 304, wherein the relative position of the fixing-unit bottom plate 304 with respect to the fixing roller 301 is substantially fixed even if the above-mentioned fluctuation may occur to components configuring the fixing unit 30. As such, the transfer-position-exit-side guide unit 210 can be positioned with respect to the fixing-unit bottom plate 304, and thereby the transfer-position-exit-side guide unit 210 can be positioned with respect to the fixing roller 301 (used as fixing member).

Further, the upstream side of the transfer-position-exit-side guide unit 210 is positioned with respect to the transfer-counter-roller ball bearing 12*a* of the secondary-transfer counter roller 12 included in the intermediate transfer unit 110 (toner image carrying member). As such, the transfer-position-exit-side guide unit 210 can be positioned with respect to the transfer-counter-roller ball bearing 12*a*, and thereby the transfer-position-exit-side guide unit 210 can be positioned with respect to the secondary-transfer counter roller 12.

In such modified example 1, in the image forming apparatus 500, adding effect of tolerance of parts can be reduced for the secondary-transfer counter roller 12 compared to a method positioning the transfer-position-exit-side guide unit 210 using the apparatus housing 200 of the image forming apparatus 500 and a casing of the secondary transfer unit 201 (e.g., unit casing 205).

With such configuration, the relative position precision of the transfer-position-exit-side guide unit 210 with respect to the intermediate transfer belt 10 and the fixing roller 301 can be enhanced, and thereby sheet transporting performance at the exit side of the secondary transfer position can be enhanced.

Further, even if the relative position of the intermediate transfer unit 110 and the fixing unit 30 may deviate from a preferable position in the image forming apparatus 500, the transfer-position-exit-side guide unit 210 can follow such deviation, by which the relative position of the transfer-position-exit-side guide unit 210 with respect to the intermediate transfer unit 110 and the fixing unit 30 can be maintained at a preferable level, and thereby sheet transporting performance can be maintained at a preferable level. By enhancing sheet transporting performance at the exit side of the secondary transfer position, occurrence of wrinkle on sheet during the fixing process can be reduced.

Further, the image forming apparatus 500 includes registration unit having the registration roller 28 composed of two rollers facing each other. The transfer sheet 25 is sandwiched between the two rollers, and by rotating one of two rollers (i.e., registration drive roller 282) at a given timing, the transfer sheet 25 is applied with transportation force.

In the modified example 2, the image forming apparatus 500 uses the intermediate transfer belt 10 as a downstream-side transportation member, and the registration roller 28 as an upstream-side transportation member.

The transfer-position-entry-side guide member 121 is disposed at the upstream side of sheet transport direction of the transfer sheet 25 with respect to the secondary transfer position. The upstream side of the transfer-position-entry-side guide member 121 is positioned with respect to the registration-roller ball bearing 281*a* of the registration driven roller 281, wherein the relative position of the registration-roller ball bearing 281*a* with respect to the registration roller 28 is substantially fixed even if positional instability may occur to components configuring the registration unit. As such, the transfer-position-entry-side guide member 121 can be positioned with respect to the registration-roller ball bearing 281*a*, and thereby the transfer-position-entry-side guide member 121 can be positioned with respect to the registration roller 28.

Further, the downstream side of transfer-position-entry-side guide member 121 is positioned with respect to the transfer-counter-roller ball bearing 12*a* of the secondary-transfer counter roller 12 included in the intermediate transfer unit 110. As such, the transfer-position-entry-side guide member 121 can be positioned with respect to the transfer-counter-roller ball bearing 12*a*, and thereby the transfer-position-entry-side guide member 121 can be positioned with respect to the secondary-transfer counter roller 12.

In the modified example 2, in the image forming apparatus 500, adding effect of tolerance of parts can be reduced for the secondary-transfer counter roller 12 and the registration roller 28 compared to a method positioning the transfer-position-entry-side guide member 121 using the apparatus housing 200 of the image forming apparatus 500 and a casing of the intermediate transfer unit 110.

Accordingly, the relative position precision of the transfer-position-entry-side guide member 121 with respect to the secondary-transfer counter roller 12 and the registration roller 28 can be enhanced, by which sheet transporting performance can be enhanced.

Further, even if the relative position of secondary-transfer counter roller 12 and the registration roller 28 may deviate from a preferable position in the image forming apparatus 500, the transfer-position-entry-side guide member 121 can follow such deviation, by which relative position of the transfer-position-entry-side guide member 121 with respect to the secondary-transfer counter roller 12 and the registration roller 28 can be maintained at a preferable level, and thereby sheet transporting performance can be maintained at a preferable level. As such, by enhancing sheet transporting performance at the entry side of the secondary transfer position, image failure during the secondary transfer process such as image is not produced in parallel on the transfer sheet 25 can be reduced.

Further, the image forming apparatus 500 includes the secondary transfer unit 201 as an image transfer device. The secondary transfer unit 201 includes the secondary transfer roller 21 to transfer an image to a recording medium. The secondary transfer roller 21 faces the intermediate transfer belt 10 at the secondary transfer position; the secondary transfer roller 21 sandwiches the transfer sheet 25 with the intermediate transfer belt 10; the secondary transfer roller 21 applies transportation force to the transfer sheet 25 by rotating the roller, and transfers toner image from the intermediate transfer belt 10 to the transfer sheet 25.

Further, the image forming apparatus 500 uses the fixing unit 30 as a fixing device or means for fixing. The fixing unit 30 includes the fixing roller 301 and the fixing belt 303 as fixing members (two surface moving members), which faces at the fixing position. The fixing roller 301 and the fixing belt 303 sandwich the transfer sheet 25 therebetween. The fixing roller 301 and the fixing belt 303 move the transfer sheet 25 by surface moving of rollers, and fix toner image on the transfer sheet 25. In the second example embodiment, the secondary transfer roller 21 may be used as an upstream-side transportation member, and the fixing roller 301 may be used as a downstream-side transportation member.

The fixing-position-entry-side guide member 305 is disposed at the upstream side of sheet transport direction of the transfer sheet 25 with respect to the fixing position. The upstream side of fixing-position-entry-side guide member 305 is positioned with respect to the transfer-position-exit-side guide unit 210, wherein the relative position of the transfer-position-exit-side guide unit 210 with respect to the secondary transfer roller 21 is substantially fixed even if the above-mentioned fluctuation may occur to components configuring the secondary transfer unit 201. As such, the fixing-position-entry-side guide member 305 can be positioned with respect to the transfer-position-exit-side guide unit 210, and thereby the fixing-position-entry-side guide member 305 can be positioned with respect to the secondary transfer roller 21.

Further, the downstream side of fixing-position-entry-side guide member 305 is positioned with respect to the fixing-roller ball bearing 301*b* of the fixing roller 301, wherein the relative position of the fixing-roller ball bearing 301*b* with respect to the fixing roller 301 is substantially fixed even if the above-mentioned instability may occur to components configuring the fixing unit 30. As such, the fixing-position-entry-side guide member 305 can be positioned with respect to the fixing-roller ball bearing 301*b*, and thereby the fixing-position-entry-side guide member 305 can be positioned with respect to the fixing roller 301.

In such second example embodiment, in the image forming apparatus 500, adding effect of tolerance of parts can be reduced for the secondary transfer roller 21 and the fixing roller 301 compared to a method positioning the fixing-position-entry-side guide member 305 using the apparatus housing 200 of the image forming apparatus 500 and a casing of the secondary transfer unit 201.

With such configuration, the relative position precision of the fixing-position-entry-side guide member 305 with respect to the secondary transfer roller 21 and the fixing roller 301 can be enhanced, by which sheet transporting performance can be enhanced.

Further, even if the relative position of the secondary transfer roller 21 and the fixing roller 301 may deviate from a preferable position in the image forming apparatus 500, the fixing-position-entry-side guide member 305 can follow such deviation, by which a relative position of the fixing-position-entry-side guide member 305 with respect to the secondary transfer roller 21 and the fixing roller 301 can be maintained at a preferable level, and thereby sheet transporting performance can be maintained at a preferable level. By enhancing sheet transporting performance at the entry side of the secondary transfer position, image failure during the secondary transfer process such as image is not produced in parallel on the transfer sheet 25 can be reduced.

Further, the image forming apparatus 500 may include the transfer-position-entry-side guide member 121, the transfer-position-exit-side guide unit 210, and the fixing-position-entry-side guide member 305. The transfer-position-entry-side guide member 121 is disposed at the upstream side of sheet transport direction of the transfer sheet 25 with respect to the secondary transfer position. The transfer-position-exit-side guide unit 210 is disposed at the downstream side of sheet transport direction with respect to the secondary transfer position. The fixing-position-entry-side guide member 305 is disposed at the upstream side of sheet transport direction with respect to the fixing position.

In the image forming apparatus 500 of the second example embodiment, each of the guide members is positioned with respect to the corresponding upstream-side positioning member and downstream-side positioning member as shown in FIG. 13.

In the second example embodiment, in the image forming apparatus 500, adding effect of tolerance of parts can be reduced for the upstream-side member (or unit) and downstream-side member (or unit) compared to a method positioning the transfer-position-exit-side guide unit 210, the transfer-position-entry-side guide member 121, and the fixing-position-entry-side guide member 305 using the apparatus housing 200 of the image forming apparatus 500, a casing of the secondary transfer unit 201, and a casing of the fixing unit 30.

Accordingly, the relative position precision of the transfer-position-exit-side guide unit 210, the transfer-position-entry-side guide member 121, and the fixing-position-entry-side guide member 305 with respect to the corresponding to the upstream-side member (or unit) and downstream-side member (or unit) can be enhanced, by which sheet transporting performance can be enhanced.

Further, even if the relative position of the secondary transfer roller 21, the registration roller 28, and the fixing roller 301 may deviate from a preferable position in the image forming apparatus 500, the transfer-position-exit-side guide unit 210, the transfer-position-entry-side guide member 121, and the fixing-position-entry-side guide member 305 can follow such deviation, by which the relative position of guide members to the respective rollers can be maintained at a preferable level, and thereby sheet transporting performance can be maintained at a preferable level. The secondary transfer roller 21, the registration roller 28, or the fixing roller 301 may be disposed as an upstream-side roller or a downstream-side roller.

As such, in the second example embodiment, by using the one-integrated system, image failure during the secondary transfer process such as image is not produced in parallel on the transfer sheet 25 at the secondary transfer position can be reduced, and also occurrence of wrinkle on sheet during the fixing process can be reduced.

Further, in the first example embodiment, the image forming apparatus 500 may include the decharging needles 401*a* to de-charge the transfer sheet 25, which has passed the secondary transfer position. The decharging needles 401*a* is disposed at the downstream side of sheet transport direction of the transfer sheet 25 with respect to the secondary transfer position. The image forming apparatus 500 may include the transfer-position-exit-side guide unit 210 as the decharging-needle support member to support the decharging member 401 having the decharging needles 401*a*. The transfer-position-exit-side guide unit 210 is positioned with respect to the transfer-shaft ball bearing 21*a* of the secondary transfer roller 21 and the fixing-unit bottom plate 304 of the fixing unit 30.

The relative position of the transfer-shaft ball bearing 21*a* with respect to the secondary transfer roller 21 is substantially fixed even if the above-mentioned instability may occur to components configuring the secondary transfer unit 201; and the relative position of the fixing-unit bottom plate 304 with respect to the fixing roller 301 is substantially fixed even if the above-mentioned instability may occur to components configuring the fixing unit 30.

In such first example embodiment, in the image forming apparatus 500, the relative position and relative position precision between the decharging needles 401*a* of the decharging member 401 and the secondary transfer roller 21 can be enhanced, wherein the decharging member 401 is used to separate the transfer sheet 25 from the intermediate transfer belt 10 effectively. Such decharging member 401 may be preferably employed for the image forming apparatus. With such configuration, separation performance can be enhanced, and sheet transporting performance can be can be enhanced, by which occurrence of wrinkle on sheet during the fixing process can be reduced.

Further, in the first example embodiment, the image forming apparatus 500 includes the secondary transfer roller 21 as an upstream-side transportation member, and the fixing roller 301 as a downstream-side transportation member. The secondary transfer roller 21 and the fixing roller 301 rotate to move the transfer sheet 25. Accordingly, the secondary transfer roller 21 and the fixing roller 301 can be referred to as a rotatable member. The upstream side of sheet transport direction of the transfer-position-exit-side guide unit 210 is positioned with respect to the rotary shaft of the secondary transfer roller 21 via the transfer-shaft ball bearing 21*a*.

Further, in the image forming apparatus 500 of the first example embodiment, the downstream side of sheet transport direction of the transfer-position-exit-side guide unit 210 is positioned with respect to the abutting portion 306 of the fixing-unit bottom plate 304 (used as downstream-side positioning member) of the fixing unit 30 (used as downstream-side transportation unit) using the exit-side guide biasing spring 215 made of an elastic material. Under such configuration, when biasing force of the exit-side guide biasing spring 215 is deactivated, the transfer-position-exit-side guide unit 210 can be disengaged from the fixing unit 30 easily, by which the secondary transfer unit 201 can be easily detached from the fixing unit 30. Further, sheet transporting performance can be enhanced. Such method using a biasing member (e.g., spring) to position the transfer-position-exit-side guide unit 210 with respect to the fixing unit 30 can be similarly used for another guide members and corresponding upstream-side or downstream-side transportation unit.

Further, the image forming apparatus 500 uses the intermediate transfer belt 10 as toner image carrying member. Specifically, toner image formed on the photoconductor 1 (latent image carrying member) is transferred to the intermediate transfer belt 10. The intermediate transfer belt 10 faces the transfer sheet 25 (recording medium) at the transfer position, and transferred the toner image to the transfer sheet 25 at the secondary transfer position. A toner image carrying member facing the transfer sheet 25 is not limited to the intermediate transfer member, but a latent image carrying member can be used. However, an intermediate transfer member having no photoconductive layer can be made of various materials, and design layout can be devised in greater variation.

Further, the image forming apparatus 500 may employ a vertical transportation type for the transportation route. Such transportation route may extend from the registration roller 28 (upstream-side transportation member) to the secondary transfer roller 21 (downstream-side transportation member); from the secondary transfer roller 21 (upstream-side transportation member) to the fixing roller 301 (downstream-side transportation member), in which the transfer sheet 25 may be transported upward in a vertical direction. In such image forming apparatus 500 using vertical transportation type, gravity force may not be used to assist transportation of the transfer sheet 25 along the guide members. Accordingly, relative position precision between an upstream-side transportation member and a guide member, and relative position precision between the guide member and a downstream-side transportation member becomes important. In the image forming apparatus 500, relative position precision of the guide member and the upstream side and downstream-side transportation member can be enhanced, and thereby sheet transporting performance of the transfer sheet 25 near the guide member can be enhanced.

In the above-described image forming apparatus, two transportation members may be disposed adjacently along a transport direction of recording medium while maintaining a given relative positional relationship. Although such relative position of two transportation members may fluctuate, such instability may not affect sheet transporting performance between the two transportation members, by which sheet transporting performance in an image forming apparatus can be enhanced.

In the above-described image forming apparatus, an upstream-side transportation member (or unit) may include an upstream side positioning member, which is used to position the guide member. Accordingly, the guide member can be positioned with respect to the upstream-side positioning member, and thereby the guide member can be positioned and fixed with respect to the upstream-side transportation member (or unit) preferably. Accordingly, a recording medium can be transported from the upstream-side transportation member (or unit) to the guide member effectively, by which sheet transporting performance in an image forming apparatus can be enhanced.

Further, in the above-described image forming apparatus, a downstream-side transportation member (or unit) may include a downstream side positioning member, which is used to position the guide member. Accordingly, the guide member can be positioned with respect to the downstream-side positioning member, and thereby the guide member can be positioned and fixed with respect to the downstream-side transportation member (or unit) preferably. Accordingly, a recording medium can be transported from the guide member to the downstream-side transportation member (or unit) effectively, by which sheet transporting performance can be enhanced.

In the above-described image forming apparatus, sheet transporting performance from the upstream-side transportation member to the guide member, and sheet transporting performance from the guide member to the downstream-side transportation member can be secured at preferable level. Accordingly, sheet transporting performance between transportation members, adjacently disposed along the transport direction of recording medium, can be secured at preferable level.

Numerous additional modifications and variations are possible in light of the above teachings. It is therefore to be understood that within the scope of the appended claims, the disclosure of the present invention may be practiced otherwise than as specifically described herein. For example, elements and/or features of different examples and illustrative embodiments may be combined each other and/or substituted for each other within the scope of this disclosure and appended claims.

What is claimed is:

1. An image forming apparatus, comprising:

a toner image carrying member to carry a toner image and move endlessly;

an image transfer device to transfer the toner image from the toner image carrying member to a recording medium at a transfer position, the transfer position being set between the toner image carrying member and the image transfer device;

a fixing device, being disposed at a downstream side of the transfer position, to fix the toner image, transferred by the image transfer device on the recording medium, on the recording medium at a fixing position;

a registration unit to transport the recording medium to the transfer position at a given timing, the registration unit being disposed at an upstream side of the transfer position;

a guide member to guide movement of the recording medium, the guide member being shaped to facilitate movement of the recording medium;

an elastic biasing member;

an upstream-side transportation member, disposed at an upstream side in a transport direction of the recording medium with respect to the guide member to move the recording medium;

an upstream-side transportation unit including the upstream-side transportation member;

a downstream-side transportation member, disposed at a downstream side in the transport direction of the recording medium with respect to the guide member to move the recording medium; and a downstream-side transportation unit including the downstream-side transportation member, wherein the upstream-side transportation unit includes an upstream-side positioning member to position the guide member to the upstream-side transportation member, wherein the downstream-side transportation unit includes a downstream-side positioning member to position the guide member to the downstream-side transportation member, wherein the guide member, disposed between the upstream-side transportation unit and the downstream-side transportation unit, is positioned by the upstream-side positioning member and the downstream-side positioning member, wherein each of the upstream-side transportation member and the downstream-side transportation member includes a rotatable member to rotate to move the recording medium, wherein the guide member includes an upstream end side and a downstream end side with respect to the transport direction of the recording medium, wherein at least one of the upstream end side and downstream end side of the guide member is positioned at a rotary shaft of the rotatable member, and wherein the end side of the guide member that is not positioned at the rotary shaft of the rotatable member is positioned at one of the upstream-side positioning member and the downstream-side positioning member by using the biasing member to apply a biasing force to one of the upstream-side positioning member and the downstream-side positioning member.

2. The image forming apparatus according to claim 1, wherein the image transfer device includes a transfer roller facing the toner image carrying member at the transfer position that sandwiches the recording medium with the toner image carrying member, rotates on a rotary shaft to move the recording medium, and transfers the toner image from the toner image carrying member to the recording medium, one of the upstream-side transportation member and the downstream-side transportation member is the transfer roller, the guide member is disposed at one of the downstream side and the upstream side in the transport direction of the recording medium with respect to the transfer position by positioning the guide member to the rotary shaft of the transfer roller.

3. The image forming apparatus according to claim 2, wherein the fixing device includes two fixing members disposed facing each other at the fixing position as surface moving members that sandwich the recording medium therebetween, fix the toner image on the recording medium, and move the recording medium, wherein the upstream-side transportation member is the transfer roller and the downstream-side transportation member is the fixing member, the guide member is a transfer-position-exit-side guide member disposed at the downstream side in the transport direction of the recording medium with respect to the transfer position, and the transfer-position-exit-side guide member is positioned at a rotary shaft of the fixing member and the rotary shaft of the transfer roller.

4. The image forming apparatus according to claim 2, wherein the registration unit includes two registration rollers disposed facing each other, the registration rollers sandwich the recording medium therebetween, and at least one of the two registration rollers is driven to rotate to move the recording medium at a given timing, the downstream-side transportation member is the transfer roller, and the upstream-side transportation member is the registration rollers, the guide member is a transfer-position-entry-side guide member disposed at the upstream side in the transport direction of the recording medium with respect to the transfer position, and the transfer-position-entry-side guide member is positioned at a rotary shaft of the registration roller and the rotary shaft of the transfer roller.

5. The image forming apparatus according to claim 1, wherein the image transfer device includes a transfer roller facing the toner image carrying member at the transfer position that sandwiches the recording medium with the toner image carrying member, rotates to move the recording medium, and transfers the toner image from the toner image carrying member to the recording medium, one of the upstream-side transportation member and the downstream-side transportation member is the toner image carrying member, the guide member is disposed at one of the downstream side and upstream side in the transport direction of the recording medium with respect to the transfer position by positioning the guide member to a counter member supporting the toner image carrying member and counter-facing the transfer roller.

6. The image forming apparatus according to claim 5, wherein the fixing device includes two fixing members disposed facing each other at the fixing position as surface moving members that sandwich the recording medium therebetween, fix the toner image on the recording medium, and move the recording medium, wherein the upstream-side transportation member is the toner image carrying member and the downstream-side transportation member is the fixing member, the guide member is a transfer-position-exit-side guide member disposed at the downstream side in the transport direction of the recording medium with respect to the transfer position, and the transfer-position-exit-side guide member is positioned at the fixing member and a counter member supporting the toner image carrying member and counter-facing the transfer roller.

7. The image forming apparatus according to claim 5, wherein the registration unit includes two registration rollers disposed facing each other, the registration rollers sandwich the recording medium therebetween, and at least one of the two registration rollers is driven to rotate to move the recording medium at a given timing, the downstream-side transportation member is the toner image carrying member, and the upstream-side transportation member is the registration rollers, the guide member is a transfer-position-entry-side guide member, disposed at the upstream side in the transport direction of the recording medium with respect to the transfer position, and the transfer-position-entry-side guide member is positioned at the registration rollers and a counter member supporting the toner image carrying member and counter-facing the transfer roller.

8. The image forming apparatus according to claim 1, wherein the image transfer device includes a transfer roller disposed facing the toner image carrying member at the transfer position that sandwiches the recording medium with the toner image carrying member, rotates to move the recording medium, and transfers the toner image from the toner image carrying member to the recording medium, the fixing device includes two fixing members disposed facing each other at the fixing position as surface moving members that sandwich the recording medium therebetween, fix the toner image on the recording medium, and move the recording medium, the upstream-side transportation member is the transfer roller and the downstream-side transportation member is the fixing member, the guide member is a fixing-position-entry-side guide member disposed at the upstream side in the transport direction of the recording medium with respect to the fixing position, and the fixing-position-entry-side guide member is positioned at the transfer roller and the fixing member.

9. The image forming apparatus according to claim 1, wherein the guide member is a first guide member that includes a transfer-position-entry-side guide member, wherein the image forming apparatus further includes a second guide member that is a transfer-position-exit-side guide member, and a third guide member that is a fixing-position-entry-side guide member, wherein the transfer-position-entry-side guide member is disposed at the upstream side in the transport direction of the recording medium with respect to the transfer position, wherein the transfer-position-exit-side guide member is disposed at the downstream side in the transport direction of the recording medium with respect to the transfer position, wherein the fixing-position-entry-side guide member is disposed at the upstream side in the transport direction of the recording medium with respect to the fixing position, wherein each of the guide members is positioned at a corresponding upstream-side positioning member and a corresponding downstream-side positioning member provided for each of the guide members.

10. The image forming apparatus according to claim 1, further comprising:

a decharging needle, disposed at the downstream side in the transport direction of the recording medium with respect to the transfer position, to remove charges from the recording medium passing the transfer position; and a decharging needle support member to support the decharging needle, the image transfer device includes a transfer roller disposed facing the toner image carrying member at the transfer position that sandwiches the recording medium with the toner image carrying member, rotates to move the recording medium, and transfers the toner image from the toner image carrying member to the recording medium, the fixing device includes two fixing members disposed facing each other at the fixing position as surface moving members, the two fixing members sandwich the recording medium therebetween, fix the toner image on the recording medium, and move the recording medium, the decharging needle support member supporting the decharging needle is positioned at the transfer roller and the fixing unit.

11. The image forming apparatus according to claim 1, wherein the toner image carrying member is an intermediate transfer member, a toner image formed on the latent image carrying member is transferred to the intermediate transfer member and further transferred to the recording medium at the transfer position.

12. The image forming apparatus according to claim 1, wherein the recording medium is transported from the upstream-side transportation member to the downstream-side transportation member in a substantially vertical direction within the image forming apparatus.

13. An image forming apparatus, comprising:

an intermediate transfer unit including a toner image carrying member to carry a toner image and move endlessly;

an image transfer device to transfer the toner image from the toner image carrying member to a recording medium at a transfer position, the transfer position being set between the toner image carrying member and the image transfer device;

a fixing device, being disposed at a downstream side of the transfer position, to fix the toner image, transferred by the image transfer device on the recording medium, on the recording medium at a fixing position;

a registration unit to transport the recording medium to the transfer position at a given timing, the registration unit being disposed at an upstream side of the transfer position;

a guide member to guide movement of the recording medium, the guide member being fixed to the intermediate transfer unit and being shaped to facilitate movement of the recording medium;

an upstream-side transportation member, disposed at an upstream side in a transport direction of the recording medium with respect to the guide member to move the recording medium;

an upstream-side transportation unit including the upstream-side transportation member;

a downstream-side transportation member, disposed at a downstream side in the transport direction of the recording medium with respect to the guide member to move the recording medium; and a downstream-side transportation unit including the downstream-side transportation member, wherein the upstream-side transportation unit includes an upstream-side positioning member to position the guide member to the upstream-side transportation member, wherein the downstream-side transportation unit includes a downstream-side positioning member to position the guide member to the downstream-side transportation member, wherein the guide member, disposed between the upstream-side transportation unit and the downstream-side transportation unit, is positioned by the upstream-side positioning member and the downstream-side positioning member.

14. An image forming apparatus, comprising:

a toner image carrying member to carry a toner image and move endlessly;

an image transfer device to transfer the toner image from the toner image carrying member to a recording medium at a transfer position, the transfer position being set between the toner image carrying member and the image transfer device;

a fixing device, being disposed at a downstream side of the transfer position, to fix the toner image, transferred by the image transfer device on the recording medium, on the recording medium at a fixing position;

a registration unit to transport the recording medium to the transfer position at a given timing, the registration unit being disposed at an upstream side of the transfer position;

a guide member to guide movement of the recording medium, the guide member being shaped to facilitate movement of the recording medium;

an upstream-side transportation member, disposed at an upstream side in a transport direction of the recording medium with respect to the guide member to move the recording medium;

an upstream-side transportation unit including the upstream-side transportation member;

a downstream-side transportation member, disposed at a downstream side in the transport direction of the recording medium with respect to the guide member to move the recording medium;

a downstream-side transportation unit including the downstream-side transportation member, a decharging needle, disposed at the downstream side in the transport direction of the recording medium with respect to the transfer position, to remove charges from the recording medium passing the transfer position; and a decharging needle support member to support the decharging needle, wherein the upstream-side transportation unit includes an upstream-side positioning member to position the guide member to the upstream-side transportation member, wherein the downstream-side transportation unit includes a downstream-side positioning member to position the guide member to the downstream-side transportation member, wherein the guide member, disposed between the upstream-side transportation unit and the downstream-side transportation unit, is positioned by the upstream-side positioning member and the downstream-side positioning member, wherein the image transfer device includes a transfer roller disposed facing the toner image carrying member at the transfer position that sandwiches the recording medium with the toner image carrying member, rotates to move the recording medium, and transfers the toner image from the toner image carrying member to the recording medium, wherein the fixing device includes two fixing members disposed facing each other at the fixing position as surface moving members, the two fixing members sandwich the recording medium therebetween, fix the toner image on the recording medium, and move the recording medium, and wherein the decharging needle support member supporting the decharging needle is positioned at the transfer roller and the fixing unit.

15. The image forming apparatus according to claim 14, wherein the image transfer device includes a transfer roller facing the toner image carrying member at the transfer position that sandwiches the recording medium with the toner image carrying member, rotates on a rotary shaft to move the recording medium, and transfers the toner image from the toner image carrying member to the recording medium, one of the upstream-side transportation member and the downstream-side transportation member is the transfer roller, the guide member is disposed at one of the downstream side and the upstream side in the transport direction of the recording medium with respect to the transfer position by positioning the guide member to the rotary shaft of the transfer roller.

16. The image forming apparatus according to claim 15, wherein the fixing device includes two fixing members disposed facing each other at the fixing position as surface moving members that sandwich the recording medium therebetween, fix the toner image on the recording medium, and move the recording medium, wherein the upstream-side transportation member is the transfer roller and the downstream-side transportation member is the fixing member, the guide member is a transfer-position-exit-side guide member disposed at the downstream side in the transport direction of the recording medium with respect to the transfer position, and the transfer-position-exit-side guide member is positioned at a rotary shaft of the fixing member and the rotary shaft of the transfer roller.

17. The image forming apparatus according to claim 15, wherein the registration unit includes two registration rollers disposed facing each other, the registration rollers sandwich the recording medium therebetween, and at least one of the two registration rollers is driven to rotate to move the recording medium at a given timing, the downstream-side transportation member is the transfer roller, and the upstream-side transportation member is the registration rollers, the guide member is a transfer-position-entry-side guide member disposed at the upstream side in the transport direction of the recording medium with respect to the transfer position, and the transfer-position-entry-side guide member is positioned at a rotary shaft of the registration roller and the rotary shaft of the transfer roller.

18. The image forming apparatus according to claim 14, wherein the image transfer device includes a transfer roller facing the toner image carrying member at the transfer position that sandwiches the recording medium with the toner image carrying member, rotates to move the recording medium, and transfers the toner image from the toner image carrying member to the recording medium, one of the upstream-side transportation member and the downstream-side transportation member is the toner image carrying member, the guide member is disposed at one of the downstream side and upstream side in the transport direction of the recording medium with respect to the transfer position by positioning the guide member to a counter member supporting the toner image carrying member and counter-facing the transfer roller.

19. The image forming apparatus according to claim 18, wherein the fixing device includes two fixing members disposed facing each other at the fixing position as surface moving members that sandwich the recording medium therebetween, fix the toner image on the recording medium, and move the recording medium, wherein the upstream-side transportation member is the toner image carrying member and the downstream-side transportation member is the fixing member, the guide member is a transfer-position-exit-side guide member disposed at the downstream side in the transport direction of the recording medium with respect to the transfer position, and the transfer-position-exit-side guide member is positioned at the fixing member and a counter member supporting the toner image carrying member and counter-facing the transfer roller.

20. The image forming apparatus according to claim 18, wherein the registration unit includes two registration rollers disposed facing each other, the registration rollers sandwich the recording medium therebetween, and at least one of the two registration rollers is driven to rotate to move the recording medium at a given timing, the downstream-side transportation member is the toner image carrying member, and the upstream-side transportation member is the registration rollers, the guide member is a transfer-position-entry-side guide member, disposed at the upstream side in the transport direction of the recording medium with respect to the transfer position, and the transfer-position-entry-side guide member is positioned at the registration rollers and a counter member supporting the toner image carrying member and counter-facing the transfer roller.

21. The image forming apparatus according to claim 14, wherein the image transfer device includes a transfer roller disposed facing the toner image carrying member at the transfer position that sandwiches the recording medium with the toner image carrying member, rotates to move the recording medium, and transfers the toner image from the toner image carrying member to the recording medium, the fixing device includes two fixing members disposed facing each other at the fixing position as surface moving members that sandwich the recording medium therebetween, fix the toner image on the recording medium, and move the recording medium, the upstream-side transportation member is the transfer roller and the downstream-side transportation member is the fixing member, the guide member is a fixing-position-entry-side guide member disposed at the upstream side in the transport direction of the recording medium with respect to the fixing position, and the fixing-position-entry-side guide member is positioned at the transfer roller and the fixing member.

22. The image forming apparatus according to claim 14, wherein the guide member is a first guide member that includes a transfer-position-entry-side guide member, wherein the image forming apparatus further includes a second guide member that is a transfer-position-exit-side guide member, and a third guide member that is a fixing-position-entry-side guide member, wherein the transfer-position-entry-side guide member is disposed at the upstream side in the transport direction of the recording medium with respect to the transfer position, wherein the transfer-position-exit-side guide member is disposed at the downstream side in the transport direction of the recording medium with respect to the transfer position, wherein the fixing-position-entry-side guide member is disposed at the upstream side in the transport direction of the recording medium with respect to the fixing position, wherein each of the guide members is positioned at a corresponding upstream-side positioning member and a corresponding downstream-side positioning member provided for each of the guide members.

23. The image forming apparatus according to claim 14, wherein the toner image carrying member is an intermediate transfer member, a toner image formed on the latent image carrying member is transferred to the intermediate transfer member and further transferred to the recording medium at the transfer position.

24. The image forming apparatus according to claim 14, wherein the recording medium is transported from the upstream-side transportation member to the downstream-side transportation member in a substantially vertical direction within the image forming apparatus.

* * * * *